US005840007A

United States Patent [19]

Leung et al.

[11] Patent Number: 5,840,007

[45] Date of Patent: Nov. 24, 1998

[54] DECANTER CENTRIFUGE FOR PRODUCING CAKE WITH REDUCED MOISTURE CONTENT AND HIGH THROUGHPUT

[75] Inventors: Woon-Fong Leung, Sherborn; Ascher H. Shapiro, Jamaica Plain, both of Mass.

[73] Assignee: Baker Hughes Incorporated, Houston, Tex.

[21] Appl. No.: 874,187

[22] Filed: Jun. 13, 1997

Related U.S. Application Data

[63] Continuation of Ser. No. 594,989, Jan. 31, 1996, Pat. No. 5,695,442, which is a continuation-in-part of Ser. No. 468, 205, Jun. 6, 1995, Pat. No. 5,643,169.

[51] Int. Cl.[6] ..... B04B 1/20; B04B 11/00

[52] U.S. Cl. ..... 494/53; 494/56

[58] Field of Search ..... 494/1, 7, 52–54, 494/56, 85; 210/380.1, 380.3

[56] References Cited

U.S. PATENT DOCUMENTS

| | | | |
|---|---|---|---|
| 273,037 | 2/1883 | Decastro et al. . | |
| 3,404,833 | 10/1968 | Pause . | |
| 3,454,216 | 7/1969 | Hemfort . | |
| 3,623,656 | 11/1971 | Lavanchy . | |
| 3,934,792 | 1/1976 | High . | |
| 3,955,756 | 5/1976 | Hiller . | |
| 4,339,072 | 7/1982 | Hiller . | |
| 4,378,906 | 4/1983 | Epper et al. | 494/53 X |
| 4,615,690 | 10/1986 | Ecker . | |
| 4,718,886 | 1/1988 | Mackel . | |

(List continued on next page.)

FOREIGN PATENT DOCUMENTS

| | | | |
|---|---|---|---|
| 0 228 188 | 7/1987 | European Pat. Off. . | |
| 0 565 268 | 10/1993 | European Pat. Off. . | |
| 0 600 628 | 11/1993 | European Pat. Off. . | |
| 40 33 012 | 4/1992 | Germany . | |
| 41 19 003 A1 | 12/1992 | Germany . | |
| 4-310255 (A) | 11/1992 | Japan . | |
| 1622015 A1 | 7/1988 | Russian Federation . | |
| 655433 | 4/1979 | U.S.S.R. | 494/56 |
| 745543 | 7/1980 | U.S.S.R. | 494/53 |
| 2 064 997 | 6/1981 | United Kingdom . | |
| 93/22062 | 11/1993 | WIPO . | |

OTHER PUBLICATIONS

"Flow Control Structure in a Decanter Centrifuge," Research Disclosure, No. 347, Mar. 1993, pp. 191–192.

Patent Abstracts of Japan, (European Patent Office), Publication No. 58 043 253, Publication Date: Dec. 3, 1983; Applicant: Mitsui Toatsu Chem Inc.

*Primary Examiner*—Charles E. Cooley

*Attorney, Agent, or Firm*—R. Neil Sudol; Henry D. Coleman

[57] ABSTRACT

A decanter centrifuge comprises a bowl rotatable about a longitudinal axis, the bowl being provided with a cake discharge opening at one end and a liquid phase discharge opening. The bowl has a cylindrical portion and a beach portion disposed between the cylindrical portion and the cake discharge opening. A beach area is provided on an inner surface of the bowl at the beach portion of the bowl, the beach area including a first section and a second section with the second section located between the first section and the cake discharge opening. The second section of the beach area has a less steep or smaller slope than the first section. A conveyor is at least partially disposed inside the bowl for rotation about the longitudinal axis at an angular speed different from an angular rotational speed of the bowl. The conveyor includes a helical screw disposed inside the bowl for scrolling a deposited solids cake layer along the inner surface of the bowl towards the cake discharge opening. A feed element extends into the bowl and the conveyor for delivering a feed slurry into a pool inside the bowl. A flow control structure is provided in the bowl proximate to the second section of the beach area for impeding a flow of cake along the bowl towards the cake discharge opening.

16 Claims, 12 Drawing Sheets

U.S. PATENT DOCUMENTS 4,729,830 3/1988 Suzuki .
4,731,182 3/1988 High .
4,764,163 8/1988 Caldwell .
4,784,634 11/1988 Schiele ..... 494/56 X
4,950,219 8/1990 Luchetta .
5,169,377 12/1992 Schlip et al. ..... 494/53 X
5,182,020 1/1993 Grimwood .
5,217,428 6/1993 Schlip et al. .
5,252,209 10/1993 Retter .
5,261,869 11/1993 Caldwell .
5,310,399 5/1994 Suzuki .
5,328,441 7/1994 Carr .

DECANTER CENTRIFUGE FOR PRODUCING CAKE WITH REDUCED MOISTURE CONTENT AND HIGH THROUGHPUT

CROSS-REFERENCE TO RELATED APPLICATION

This application is a continuation of application Ser. No. 08/594,989 filed Jan. 31, 1996, now U.S. Pat. No. 5,695,442, which in turn was a continuation-in-part of application Ser. No. 08/468,205 filed Jun. 6, 1995, now U.S. Pat. No. 5,643,169.

BACKGROUND OF THE INVENTION

This invention relates to a decanter centrifuge. More specifically, this invention relates to a decanter centrifuge with structure for reducing the moisture content of a discharged cake or increasing solids fraction, while maintaining a relatively high cake throughput rate. This invention also relates to an associated method for operating a decanter centrifuge.

A decanter centrifuge generally includes an outer bowl, an inner hub carrying a worm conveyor, a feed arrangement for slurry to be processed, and discharge ports for cake solids and clarified liquid. The bowl includes a cylindrical section and a conical beach section. The bowl and the hub are rotated at high, yet slightly different angular speeds so that heavier solid particles of a slurry introduced into the bowl are forced by centrifugation into a layer along the inner surface thereof. By differential rotation of the worm conveyor and the bowl, the sediment is conveyed or scrolled to a cake discharge opening at the smaller, conical end of the bowl. Additional discharge openings are provided in the bowl, usually at an end opposite of the conical section for discharging a liquid phase separated from the solid particles in the centrifuge apparatus.

One of the goals in centrifuge operation is to produce cakes with a low moisture content. One proposed method, published in Research Disclosure, March 1993, Number 347, for reducing cake moisture content entails the disposition of a flow control structure proximate to the cake discharge port to reduce the volume flow rate of the cake by 25% to 75%. The flow control structure could be a ring shaped dam extending radially outwardly from the axis of the bowl, a dam disposed between two turns or wraps of the conveyor, an increased beach climb angle, an increased conveyor blade thickness, or an increased or decreased conveyor helix angle. It was asserted that by decreasing the volume flow rate of the solids by about one-half, or between 25% and 75%, the velocity at the interface between the liquids and the sedimented solids is in the reverse direction, i.e., towards the pool and away from the cake discharge port. Liquid from the pool and liquid expressed from the cake layer are drained back into the pool rather than carried out of the bowl with the sedimented solids.

Although a drier cake is obtainable by the published technique discussed above, the problem generated by such a cake flow control solution is that the cake production rate or throughput is reduced, thus increasing costs and reducing efficiency.

It is also known to form a dip weir along the outer surface of the conveyor hub, at or about the location of the junction between the cylindrical and conical sections of the bowl, to serve in selecting the driest portion of the cake at the discharge end of the bowl. The dip weir blocks the transport of the sludge cake in such a manner that the most compacted part of the cake passes under the dip weir and reaches the cake discharge opening. The dip weir also acts to provide the appropriate resistance to cake flow so as to maintain a large cake thickness upstream of the weir, creating high compacting pressure and long residence time. In conventional practice, the dip weir is fixed to the hub so that the radial gap between the outer edge of the dip weir and the inner surface of the bowl is constant or fixed. The designer must position and dimension the weir to minimize cake moisture content while not excessively increasing cake transport resistance through the gap so as to unduly limit the solids capacity of the machine. The optimal gap height depends on the nature of the cake, the G level, and the cake flow rate or solids throughput. The designer is forced to guess at the correct gap height, guided somewhat by past experience.

SUMMARY OF THE INVENTION

A decanter centrifuge in accordance with the present invention comprises a bowl rotatable about a longitudinal axis, the bowl being provided with a cake discharge opening at one end and a liquid phase discharge opening at an opposite end. The bowl has a cylindrical portion and a beach portion disposed between the cylindrical portion and the cake discharge opening. A beach area is provided on an inner surface of the bowl at the beach portion of the bowl, the beach area including a first section and a second section with the second section located between the first section and the cake discharge opening. The second section of the beach area has a less steep or smaller slope than the first section. A conveyor mounted on a conveyor hub is disposed inside the bowl for rotation about the longitudinal axis at an angular speed different from an angular rotational speed of the bowl. The conveyor includes a helical screw disposed inside the bowl for scrolling a deposited solids cake layer along the inner surface of the bowl towards the cake discharge opening. A feed element extends into the conveyor hub for delivering a feed slurry into a pool inside the bowl. A flow control structure is provided in or along the second section of the beach area, proximately to the cake discharge opening, for impeding a flow of cake along the bowl towards the cake discharge opening, thereby causing a build-up of cake height in the second section of the beach area.

The flow control structure may include a barrier which extends radially outwardly from a hub of the conveyor towards the bowl or radially inwardly from the bowl towards the conveyor. Alternatively, the flow control structure includes a portion of the helical screw having thickened wraps. In another alternative design, the flow control structure includes a portion of the helical screw having wraps inclined at an angle with respect to wraps in the cylindrical portion of the bowl and also with respect to wraps in the first section of the beach area. In this design, the change in angle impedes the flow of cake along the bowl towards the cake discharge opening.

In a different design, the flow control structure includes an additional beach section disposed between the second section of the beach area and the cake discharge opening, the additional beach section being steeper than the second section.

The first section and the second section of the beach area are contiguous with one another along a junction. According to another feature of the present invention, the liquid phase discharge opening and the junction between the first and second beach sections are disposed at approximately the same distance from the longitudinal axis of the bowl, whereby the pool is approximately coextensive with the cylindrical portion and the first section of the beach area, while the second section of the beach area is disposed outside of the pool.

In a specific embodiment of the present invention, the second section of the beach has a slope of approximately 0°.

A method for operating a decanter type centrifuge as described above comprises, in accordance with the present invention, rotating the bowl about its longitudinal axis at a first rate of rotation, delivering a feed slurry to a pool in the bowl during the bowl rotation, and also maintaining the pool at a position such that the pool level intersects a location approximately at the junction of the first and the second beach. In this arrangement, the first section of the beach area is submerged in the pool whereas the second section of the beach area is substantially disposed outside of the pool. The screw conveyor is rotated about the longitudinal axis at a rate of rotation different from the rate of rotation of the bowl, thereby scrolling a cake layer along the inner surface of the bowl towards the cake discharge opening. In a portion of the bowl proximate to the second section of the beach area, flow of the cake layer along the inner surface is impeded by the flow control structure, whereby the thickness of the cake layer in the second section is increased. Cake is discharged through the cake discharge opening, while a liquid phase is discharged through the liquid phase discharge opening in the bowl.

Impeding the flow of the cake layer may specifically entail increasing the cake flow cross-section cake flow cross-section along the second section of the beach area upstream of the flow control structure.

Where the conveyor has a hub to which a helical screw is attached, impeding the flow of the cake layer may include guiding the cake layer past a barrier extending radially outwardly from the hub towards the bowl or radially inwardly from the bowl towards the conveyor. Alternatively, impeding the flow of the cake layer may include guiding the cake layer past a portion of the conveyor having thickened screw wraps or wraps set at a helix angle different from the helix angle of the wraps in the cylindrical portion of the bowl.

Where the bowl is provided with an additional beach section disposed between the second section of the beach area and the cake discharge opening, the additional beach section being steeper than the second section, impeding the flow of the cake layer includes guiding the cake layer along the additional beach section.

A flow control structure in a decanter centrifuge in accordance with the present invention provides and regulates an additional resistance to the flow of sediment solids (cake solids) exiting the beach area of the bowl, thereby causing a buildup of cake thickness upstream of the control structures. This causes the surface of the thick sediment or cake to flow backward (i.e., backflow), thereby carrying back to the pool any expressed liquid which permeates upward to the sediment surface. The backflow of the cake surface also prevents liquid from the pool from being carried with the cake as the latter emerges from the liquid slurry pool. In consequence, a highly concentrated solids cake leaves the centrifuge.

The improvements described herein lie to a significant extent in the design and construction of the beach zone and, more particularly, in the incorporation in the beach area of the flow control structure. A first objective and result of the invention is to increase the efficiency of the beach area with respect to the conveyance capacity, that is, to increase the rate at which solids are conveyed up the beach against centrifugal force. A second objective and result of the invention, which is of equal importance to the first, is to increase the concentration of solids leaving the centrifuge, that is, to reduce the amount of liquid in the stream of cake at the point of solids discharge.

In a decanter type centrifuge in accordance with the present invention, the restriction on cake layer flow rate implemented by the flow control structure acts to establish, in the below-pool zone and the above-pool zone, a solids depth profile and a solids velocity profile which prevents liquid carry-over from the pool and also causes liquid expressed in the above-pool zone (second and optional third beach sections) to run back into the pool.

In a decanter type centrifuge in accordance with the present invention, a drier cake product is obtained with a higher cake throughput than in the prior art.

BRIEF DESCRIPTION OF THE DRAWINGS

Like reference numerals in the drawings designate the same structural elements.

DESCRIPTION

FIGS. 1–11 relate to a gating element for controlling the moisture content of cake exiting a decanter centrifuge. The remaining drawing figures relate to improvements which result in an especially low cake moisture content, without substantially reducing the rate of cake output and even increasing the rate of cake output in certain configurations of the centrifuge.

Figure 1:
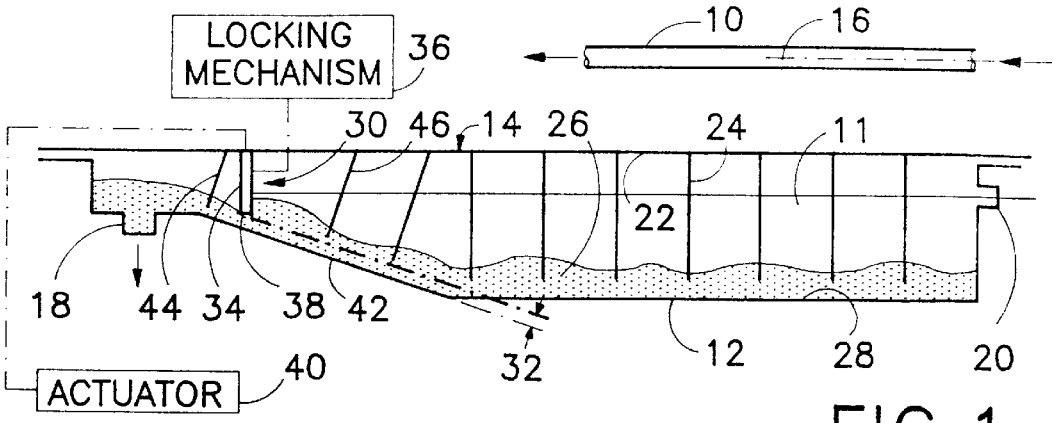
FIG. 1 is a diagram of a decanter centrifuge with an adjustable gate for moisture content control.

FIG. 1 diagrammatically illustrates the lower half of a decanter type centrifuge comprising a solid or perforated bowl 12, a worm or screw type conveyor 14, and a slurry feed arrangement that includes a feed pipe 10, a feed compartment (not shown) and one or more openings (not shown) in the conveyor hub 22 to allow slurry to pass from the feed compartment to a liquid pool 11 in the bowl. Bowl 12 is rotatable about a longitudinal axis 16 and has a cake discharge opening 18 at one end and a liquid phase discharge opening 20 at an opposite end. Conveyor hub 22 has at least a portion disposed inside bowl 12 for rotation about longitudinal axis 16 at an angular speed different from an angular rotational speed of bowl 12. Conveyor 14 further includes a helical screw or worm 24 attached to conveyor hub 22 and disposed inside bowl 12 for scrolling a cake layer 26 along an inner surface 28 of bowl 12 towards cake discharge opening 18. An adjustable component 30 on conveyor hub 22 forms a gap 32 between the hub and inner surface 28 of bowl 12 so that the gap has a size adjustable independently of hub rotation speed. Adjustable gap 32 enables an optimization of the moisture content of cake exiting bowl 12 at cake discharge opening 18 or other performance parameters.

Preferably, adjustable component 30 includes a gating element 34 movably mounted to hub 22 and locking hardware 36 for maintaining the gating element at a predeterminable location relative to the hub. Gap 32 is defined by an edge 38 of gating element 34 and the inner surface 28 of bowl 12. The magnitude of gap 32 is adjustable by shifting gating element 34 towards or away from inner surface 28. Preferably, gating element 34 is operatively connected to an actuator 40 which is disposed inside hub 22 and bowl 12, but may be disposed outside of those components. Actuator 40 is located so that the position of gating element 34 may be adjusted without significant disassembly of the decanter centrifuge.

Figure 2:
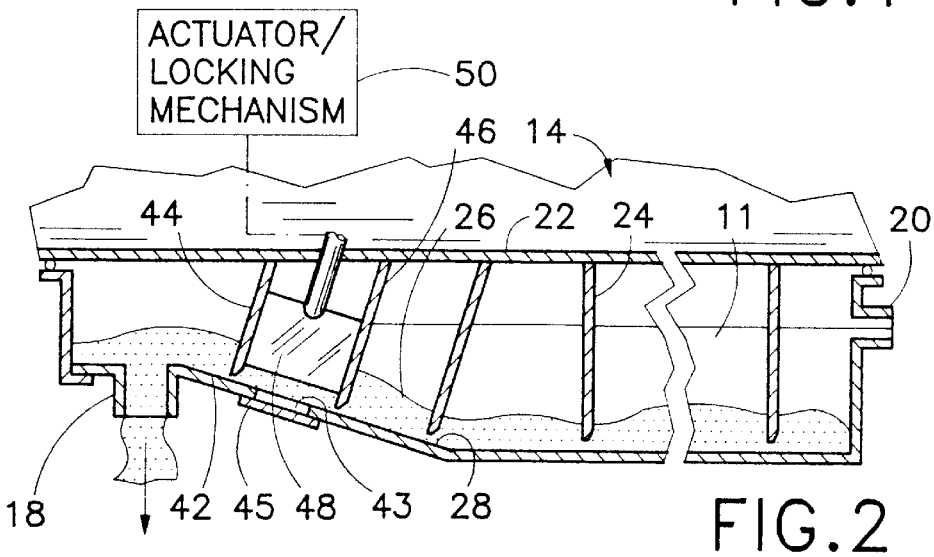
FIG. 2 is a schematic partial longitudinal cross-sectional view of a specific embodiment of a decanter centrifuge according to FIG. 1.

Generally, gating element 34 is juxtaposed to a beach section 42 of bowl 12 and cooperates therewith in defining gap 32. Gating element 34 may be disposed between a pair of adjacent wraps 44 and 46 of conveyor screw 24, as shown in FIGS. 1 and 2. Alternatively, gating element 34 may be disposed downstream of the last wrap 44 of conveyor screw 24, as discussed hereinafter with reference to FIGS. 7 and 8.

As illustrated in FIG. 2, gating element 34 may take the form of a baffle plate 48 disposed between adjacent wraps 44 and 46 of screw 24. Baffle plate 48 is disposed approximately perpendicularly to wraps 44 and 46 and may be guided in grooves 92 (see FIG. 6) provided therein. The functions of actuator 40 and locking mechanism 36 may be combined in a single hardware assembly or mechanism 50.

As discussed above, mechanism 50 may serve to enable manual or, alternatively, automatic adjustment of the gap 32 between inner surface 28 of bowl 12, on the one hand, and conveyor hub 22 or, more particularly, baffle plate 48, on the other hand. In the case of manual adjustment, mechanism 50 is at least partially mounted to conveyor hub 22 and is operatively connected to baffle plate 48 for enabling a manual adjustment. Manual adjustment may require centrifuge stoppage, followed by either partial disassembly of the decanter centrifuge or by accessing the locking mechanism 36 through an access opening 43 provided in beach section 42 of bowl 12. Alternatively, a coupling or linkage mechanism (not shown) may be provided for enabling manual adjustment even during operation of the centrifuge. For instance, where adjusting and locking hardware 50 is hydraulic (FIG. 5), slippage couplings (not shown) are provided for connecting stationary and rotating portions of the hydraulic circuit. The reservoir 70 of pressurization fluid (see FIG. 5) may be fixed or rotating with conveyor hub 22.

The position of baffle plate 48, and accordingly the gap 32 between the baffle plate and inner bowl surface 28, may be automatically varied in accordance with feedback from a sensor (not shown) monitoring cake moisture content. A microprocessor programmer (not shown) may be provided for controlling the position of baffle plate 48 pursuant to such input instructions and such variables as the nature of the cake, the G level and the cake flow rate.

Figure 3:
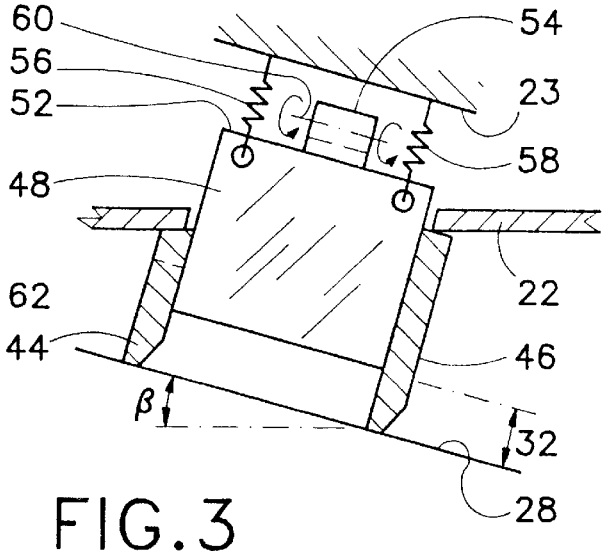
FIG. 3 is a schematic front elevational view of a gating element and a particular embodiment of an associated actuator and locking mechanism shown in FIG. 2.
Figure 4:
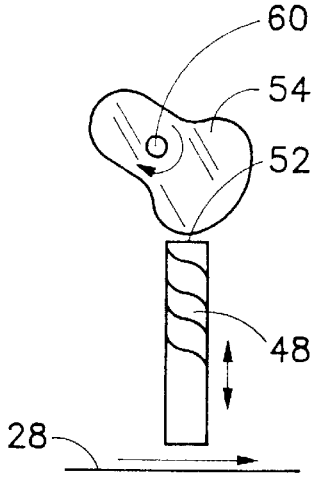
FIG. 4 is a schematic side view of the gating element and associated cam actuator and locking mechanism of FIG. 3.

FIGS. 3 and 4 illustrate a specific embodiment of actuator and locking mechanism 50. A radially inner edge 52 of baffle plate 48 is held in engagement with a camming element 54 by means of one or more biasing springs 56 and 58 coupled at their inner ends to a plate 23 fixed to conveyor hub 22. As camming element 54 is turned or pivoted about an eccentric axis of rotation 60 via a non-illustrated linkage mechanism, baffle plate 48 reciprocates in a radial direction, thereby modifying the size of gap 32. Camming element 54 and springs 56 and 58 are housed inside conveyor hub 22 to prevent solids from jamming the mechanism. Conveyor wrap 44 can be provided with a window 62 traversed by the linkage mechanism (not illustrated).

Baffle plate 48 may be located in a plane which is approximately parallel to the common longitudinal axis 16 (FIG. 1) of rotation of bowl 12 and conveyor hub 22. This orientation is not critical, however, and the baffle plate 48 may be disposed in a plane oriented at an angle relative to rotation axis 16. Moreover, a second baffle plate (not shown) may be provided on conveyor hub 22 in diametric opposition to baffle plate 48.

Gating element 34 and, more particularly, baffle plate 48 serves to control the solids concentration admitted for discharge at opening 18. Baffle plate(s) 48 divides the annular space between bowl 12 and conveyor hub 22 into two regions with a distinct difference in liquid pool and solids level across the baffle plate. Upstream of baffle plate 48, in a direction opposite to the flow of cake layer 26, the pool and solids level is deeper as set by the centrate weir. The deeper pool enhances clarification and a build-up of a thicker cake layer 26 for compaction and dewatering and also provides buoyancy to reduce conveyance torque. Downstream of baffle plate 48, the solids level is controlled by the spillover point of beach section 42. There cake layer 26 is strongly affected by the centrifugal field such that the surface of the cake layer is roughly parallel to rotation axis 16 and is approximately at the radius of the spillover. The baffle plate 48 skims off the driest solids adjacent to bowl inner surface 28.

Cake solids in gap 32, which is generally between 0.25 and 1.5 inches wide, depending on the process, the size of the machine and the throughput, form a "plug" to seal the deep pool 11 on the upstream side of the machine (right side in FIGS. 1 and 2) from the shallower pool with concentrated solids on the downstream side of the machine (beach discharge end at the left side in FIGS. 1 and 2). The position of baffle plate 48 relative to wraps 44 and 46 should be adjusted to change the size of gap 32 as needed by the process, specifically to skim off the driest solids near the bowl wall or to reduce instability caused by washout of the plug. It is desirable to have the size of gap 32 adjustable while the machine is running. However, it is satisfactory when the position of baffle plate 48 can be adjusted without disassembling the machine, for instance through access opening 43 under cover plate 45, while the centrifuge is stationary.

Figure 5:
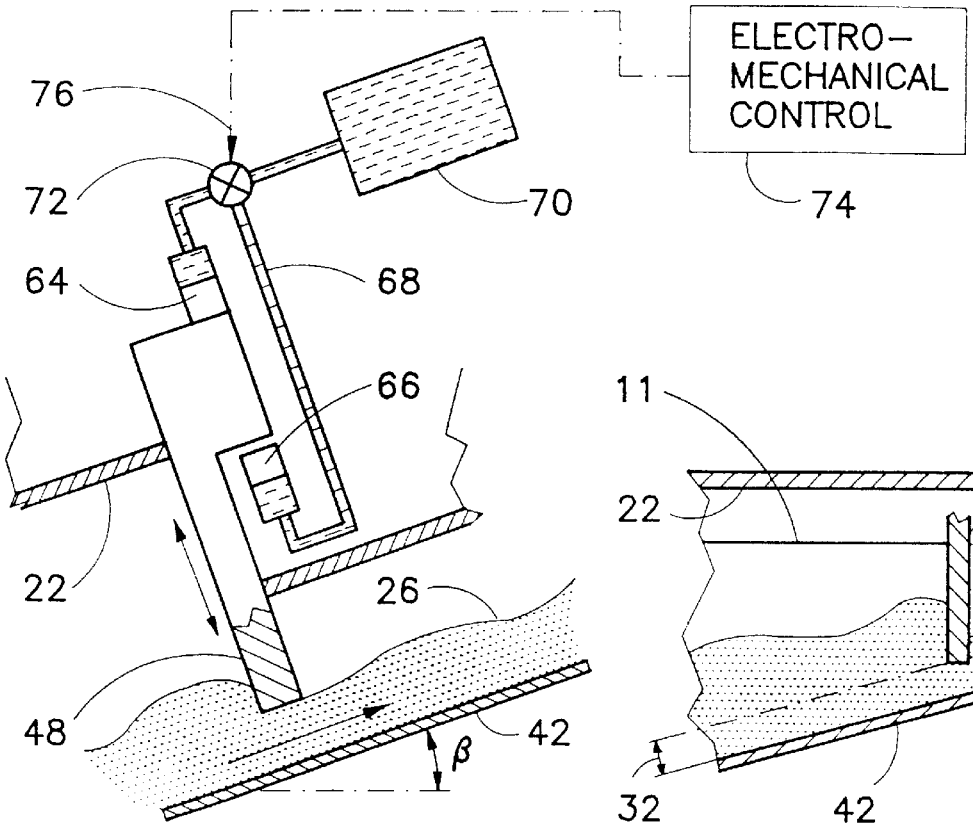
FIG. 5 is a schematic side elevational view of another gating element and associated fluid actuator and locking mechanism for implementing the decanter centrifuge of FIG. 2.

As illustrated in FIG. 5, another specific embodiment of actuator and locking mechanism 50 includes a pair of pistons 64 and 66 connected in a hydraulic circuit 68 to a pressurized oil reservoir 70 via a closed-loop hydraulic switch or valve 72 which is remotely controlled via an electro-mechanical control 74 external to bowl 12.

The linkage mechanism for turning camming element 54 (FIGS. 3 and 4) or a connection 76 from electro-mechanical control 74 (FIG. 5) may rotate with conveyor hub 22. To effectuate an adjustment in the position of baffle plate 48, slippage couplings (not shown) are provided for connecting stationary and rotating portions of actuator and locking mechanism 50. In this case, baffle plate 48 can be adjusted while the machine is running.

Figure 6:
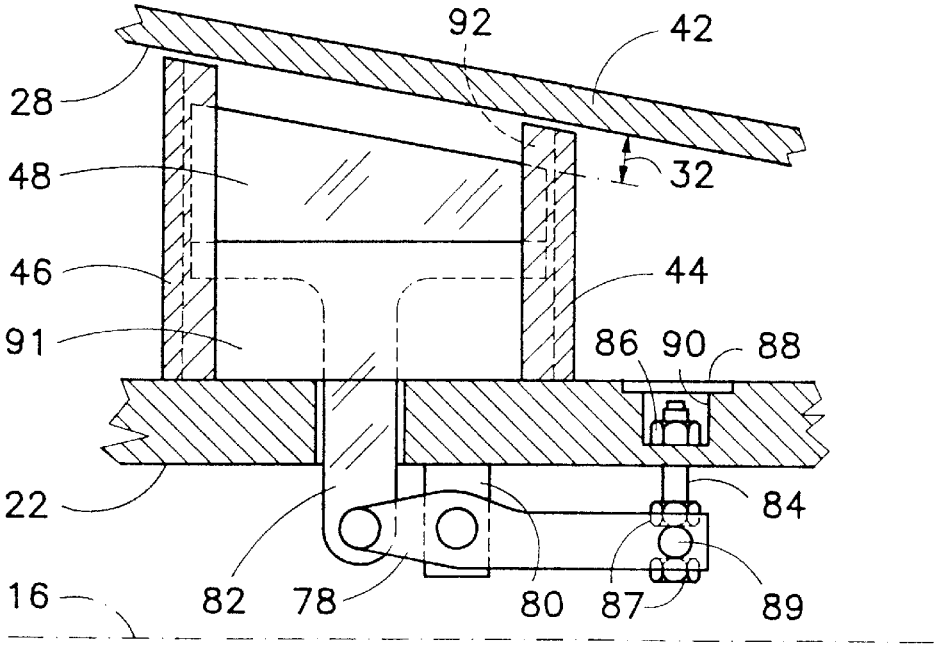
FIG. 6 is a schematic front elevational view of yet another gating element and associated actuator and locking mechanism for implementing the decanter centrifuge of FIG. 2.

FIG. 6 depicts yet another embodiment of actuator and locking mechanism 50 which includes a rocker-arm lever 78 pivotably connected to hub 22 via a fulcrum post 80 and pivotably linked at one end to a stub 82 of baffle plate 48. At an opposite end, the orientation of rocker-arm lever 78 is controlled by a stud 84 threaded to the conveyor hub 22 by a locknut 86 during centrifuge operation. A cover 88 is provided on hub 22 over an access aperture 90. Retainers such as brazed jam nuts 87 are provided on opposite sides of lever arm 78 for suitably securing stud 84 thereto. Lever arm 78 is further furnished with a swivel 89 having a throughhole for providing a rotating fit for stud 84.

Baffle plate 48 is preferably made of titanium with a ceramic wear surface and is slidably arranged between two fixed plates 91 and in grooves 92 provided in conveyor worm wraps 44 and 46. Baffle plate 48 may be maintained in position partially by virtue of centrifugal force.

Where only one baffle plate 48 is provided, conveyor hub 22 is balanced with the baffle plate installed and positioned centrally with respect to its range. Any further minor changes may be counterbalanced with a large-diameter set screw and locking nut (not shown) 180° opposite in the end of the conveyor hub 22.

Figure 7:
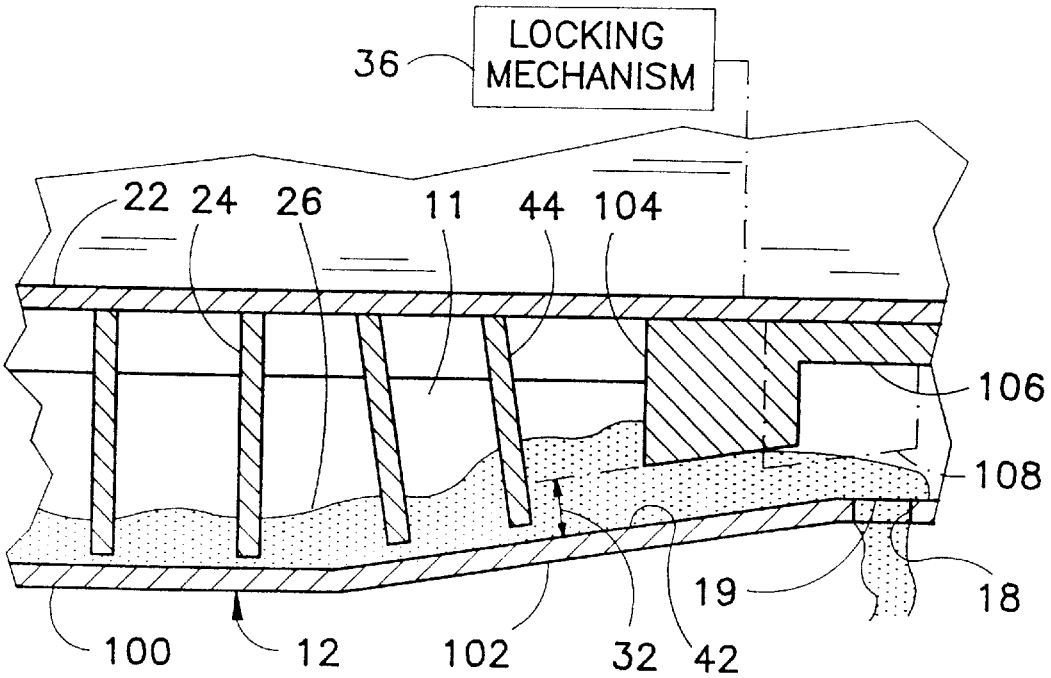
FIG. 7 is a schematic partial longitudinal cross-sectional view of another embodiment of a decanter centrifuge according to FIG. 1.

In another specific configuration of the decanter centrifuge, illustrated in FIG. 7, bowl 12 has a cylindrical portion 100 and a conical portion 102 defining beach section 42 along its inner surface. Gating element 34 takes the form of an annular dip weir 104 disposable at different longitudinal positions along conveyor hub 22. Dip weir 104 is provided with an annular rod 106 extending outside of centrifuge bowl 12 for enabling a manual repositioning of weir 104, as indicated by phantom lines 108, to change the size of gap 32 between dip weir 104 and beach section or surface 42. Rod 106 enables weir position adjustment from outside the machine, without disassembly. Moreover, as discussed hereinabove, this adjustment may be implemented while the machine is running, in the event that slippage couplings (not shown) are provided for connecting stationary and rotating portions of rod 106. Alternatively, the position of dip weir 104 may be adjusted by shutting down the machine, reaching in through an access opening 43 under cover plate 45 in bowl 12, manually unlocking the dip weir, and sliding it axially to another position. Dip weir 104 is then fixed in the new position relative to hub 22 by locking hardware or mechanism 36 (FIG. 1).

It is to be noted that for compactible cake solids, decanter centrifuges generally run with "superpool": the pool level (set by effluent weirs) is radially inward of the radial position of cake discharge opening 19. All the cake 26 is therefore acted upon by buoyancy and, in addition, "hydraulic assist" due to the superpool head forces the cake toward cake discharge opening(s) 18. With the design of FIG. 7, the amount of superpool must be set large enough so that cake layer 26 is transported to cake discharge opening(s) 19 even though part of beach section 42 is without a conveyor.

Figure 8:
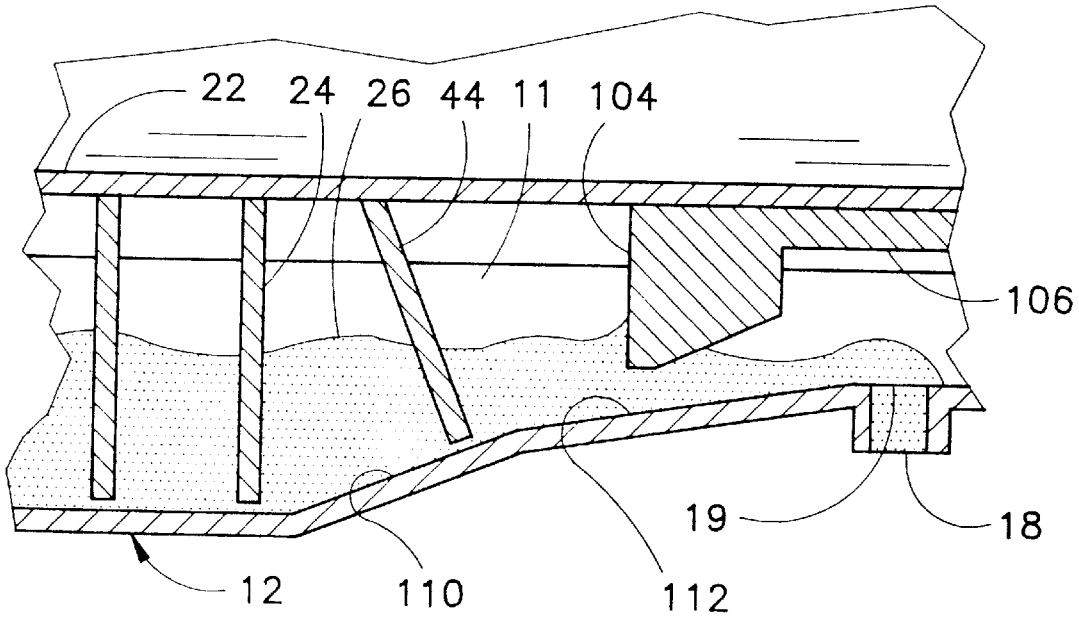
FIG. 8 is a view similar to FIG. 7, showing a modification of the decanter centrifuge of that drawing figure.

As illustrated in FIG. 8, the embodiment of FIG. 7 may be modified by dividing beach section 42 into two portions or areas 110 and 112 with different slopes. Dip weir 104 is positionable along beach portion 112 which has a smaller slope than beach area 110, thereby providing a greater degree of adjustability in the size of gap 32. The increased amount of superpool head required by the conveyor-free portion 112 of beach section 42 may be used to further advantage in the configuration of FIG. 8. Here, beach portion 110 is provided with conveyor wraps 114 and is steeper than beach portion 112. This allows the conveyor-free beach portion 112 to be longer, without changing the overall length.

In the embodiments of FIGS. 7 and 8, dip weir 104 has an outer diameter which decreases in a direction of cake advancement, towards discharge opening 18. In a modified configuration, dip weir 104 may have an external diameter which increases from left to right in FIGS. 7 and 8.

Figure 9:
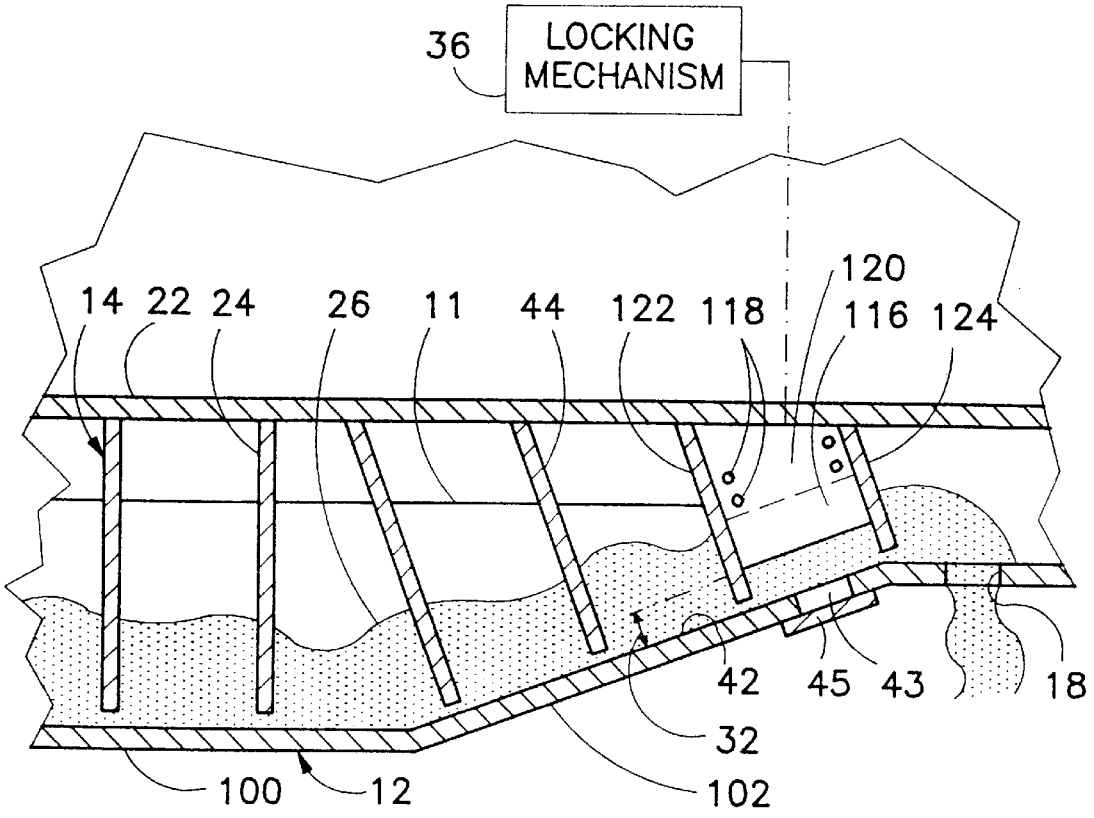
FIG. 9 is a schematic partial longitudinal cross-sectional view of a baffle bolted onto a mounting bracket which bridges across adjacent screw wraps.

As depicted in FIG. 9, a modified decanter centrifuge includes a cake gating or metering mechanism in the form of a baffle plate 116 attached via bolts 118 to a bracket 120 which in turn extends between and is connected to adjacent wraps 122 and 124 of conveyor 14. To adjust gap 32 between baffle plate 116 and beach section 42 of bowl 12, cover plate 45 is removed to allow access to the baffle plate through opening 43. Bolts 118 are loosened and baffle plate 116 shifted relative to bracket 120.

Figure 10:
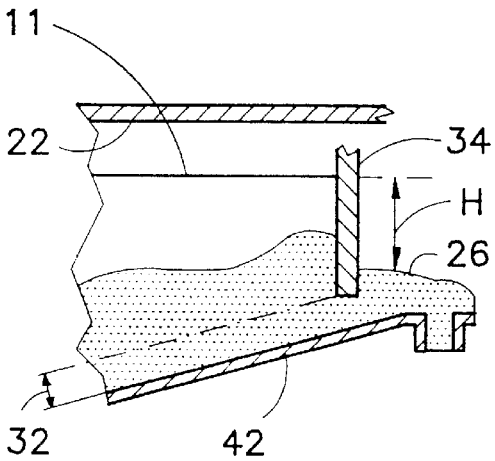
FIG. 10 is a baffle plate or gating element in accordance with the present invention, showing a difference in heights between clarified liquid on one side and cake on an opposite side of the baffle plate.

Another purpose of having an adjustable baffle/gating element is to foster a deep pool operation (which is beneficial as discussed above) such that the pool level is very much above the spill-over point (super-pool) as indicated schematically by the distance H in FIG. 10 between the height of cake 26 at an outlet side of baffle or gating element 34 and the height of pool 11. How much the pool level increments across baffle or gating element 34 depends on the flow resistance, which in turn depends on the solids rate, the size of gap 32 and the rheological properties of the cake. Gap 32 is usually between 0.25 inch and 1.5 inch. For a high solids rate, gap 32 can have a moderate width. For a low solids rate, the gap needs to be smaller to provide the same resistance. For raw mixed sludge with primary sludge that has fiber and substrate materials, the width of gap 32 should be moderate, whereas for waste activated sludge or digested sludge without fibrous materials, the gap needs to be smaller.

Figure 11:
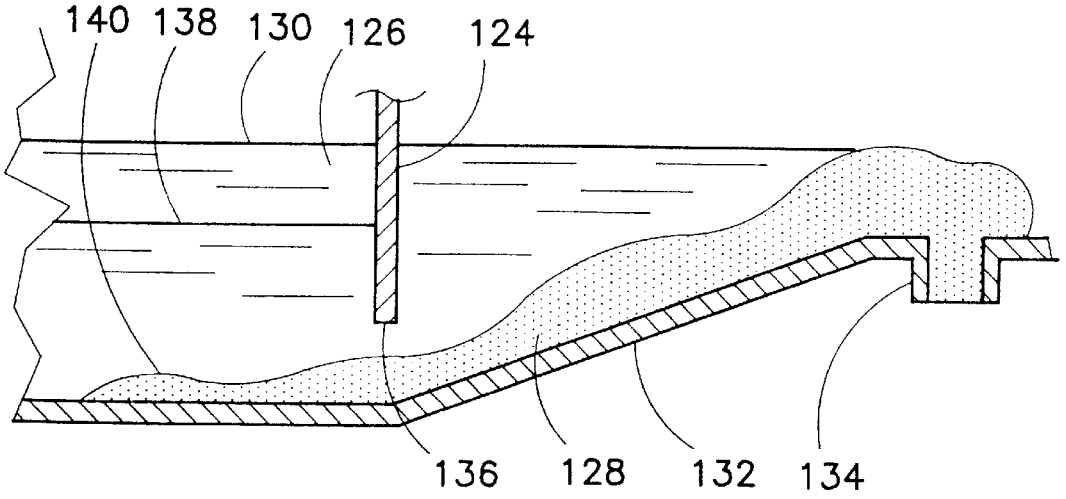
FIG. 11 is a schematic partial longitudinal cross-sectional view of a decanter centrifuge with a moisture control gating element, depicting use of the gating element to facilitate a three-phase separation process.

FIG. 11 illustrates use of an adjustably positioned gating element 124 as described hereinabove to facilitate a three-phase separation process to prevent a lightest phase such as oil 126 from being entrained by a cake or solid phase 128 as the latter emerges from an oil-water pool 130 at a conical section 132 of a decanter centrifuge (not designated). Gating element 124 may take the form of a dip weir which is placed upstream of a solids emergence zone 134 so as to reduce entrainment of oil phase 126 by cake or solid phase 128. An outer edge 136 of dip weir 124 must penetrate beyond an oil-water interface 138 to be effective. A dip weir with a tight opening would be ideal if not for the fact that it might run into cake solids layer 128, which for granular solids can generate undesirable high torque. Given that the location of oil-water interface 138 and a water-solid interface 140 are not known, the centrifuge has to be operated with close monitoring of the oil discharged with the cake solids 128 and the torque level experienced by the machine. The adjustable gap enables optimization in response to the monitoring.

A decanter centrifuge with an adjustable gating element as disclosed above with reference to FIGS. 1–11 demonstrates certain advantages with respect to the classification of fine solids. However, although the moisture content of the cake is controllable to a substantial extent, large reductions in moisture content are not possible without compromising the production rate. As discussed below, cake moisture content may be reduced dramatically, without substantially reducing the cake production rate, by using a gating element or, more generally, a cake flow control structure, in conjunction with a compound beach. Results are optimized when the pool level and the junction between a first beach section and a less steep downstream beach section are located at approximately the same distance from the centrifuge rotation axis.

Conceptual Considerations

The concept of a flow control structure in the beach zone arises as a consequence of far-reaching theoretical analyses, followed by extensive confirmatory laboratory tests of models of the beach zone. As background for understanding the rationale of the present inventions, the underlying theoretical considerations are summarized here.

Development on a Plane

Figure 13:
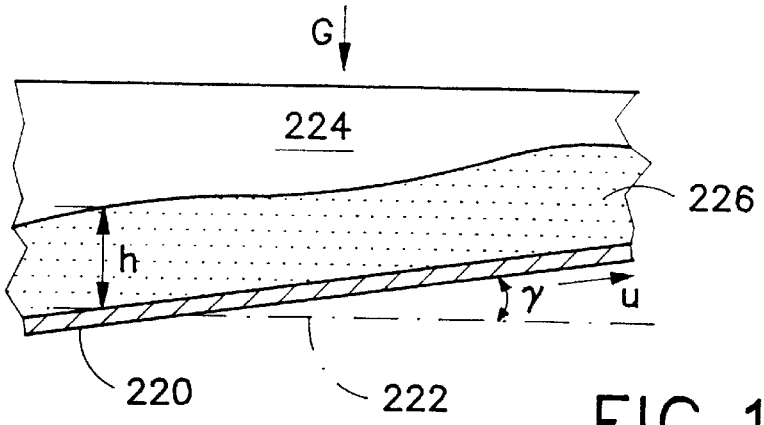
FIG. 13 is a diagram, essentially looking along a helical cut, parallel to a conveyor vane, showing a cake layer on a beach surface of a bowl of a decanter centrifuge.
Figure 12:
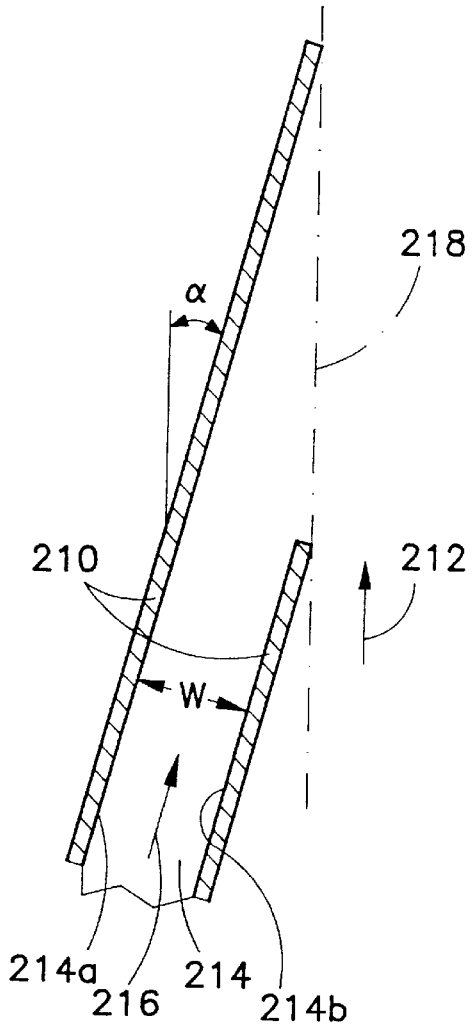
FIG. 12 is a diagram, looking down on an inner surface of a flattened bowl of a decanter centrifuge, for discussing motion of a cake layer between adjacent vanes and over the bowl surface.

The inner surface of the bowl may be developed on a plane. Since the thickness of the sludge layer on the beach is generally small compared with the bowl radius, one may envisage the flow as occurring on that planar surface, tilted at the beach angle $\beta$ (see FIGS. 3 and 5) to the axial direction. FIG. 12 is a schematic view of that plane, viewed in the direction of the centrifugal field. The helical conveyor appears as a series of parallel vanes 210 inclined at the helix angle $\alpha$ to the direction of rotation 212, a direction normal to the centrifuge rotation axis 16 (FIG. 1 et seq.). Each pair of adjacent vanes 210 forms a channel 214 along which the sludge cake is guided and transported (as at 216) toward a cake discharge plane 218. Within channel 214, the sludge cake can occupy up to a maximum width W equal to the distance between the adjacent vane surfaces 214*a* and 214*b* that form the channel and extends above the inner surface of the bowl by the cake height h (FIG. 13).

Reference Frame of the Conveyor

Consider the motions as seen by an observer who moves at the same angular speed as the conveyor. In this reference frame, conveyor vanes 210 are stationary, while the plane representing the bowl wall (plane of the paper in FIG. 12) slides past them, in a direction 212 normal to the centrifuge rotation axis 16 (FIGS. 1 et seq.), with a speed equal to the bowl wall radius R multiplied by the differential angular speed between the bowl and the conveyor, $\Delta\Omega$. As a result of one component of the frictional force, the sliding of the bowl wall past the conveyor vanes tends to drag the cake against the driving face 214*a* of each vane. Even more importantly for conveyance, the other and larger component of the frictional force exerted by the bowl wall acts to drag the cake along the channel 214. The cake is transported "uphill" against the component of centrifugal force that acts in the "downhill" direction on the beach. Thus, the mechanism of cake transport may be summarized as follows: by reason of the relative motion, $R\times\Delta\Omega$, between the bowl and the conveyor vanes, the bowl drags the cake to the solids discharge end through the channels formed by the conveyor vanes, overcoming a component of the centrifugal force as well as the frictional force exerted by the vanes against the direction 216 of the cake flow.

The Belt Analog

FIG. 13 shows an analog that contains the important features of the process described above and that reveals in an especially simple manner the concepts of the present invention. A belt 220 representing the bowl wall is inclined at a "climb angle" $\gamma$ to the "horizontal" 222, which is normal to the centrifugal field G. Belt 220 moves in an uphill direction with a relative speed U equal to the triple product of the bowl inner surface radius R, the differential angular speed $\Delta\Omega$, and $\cos(\alpha)$, where $\alpha$ is the helix angle (FIG. 12). For all practical purposes, $U=(R\times\Delta\Omega)$ inasmuch as $\alpha$ is generally less than 15 degrees. The frictional force applied by the belt drags the sludge cake lying on the surface of the belt uphill against a component of the centrifugal force acting on the mass of the cake.

The climb angle $\gamma$ is the effective uphill angle the sludge cake has to overcome. To a good approximation, the climb angle $\gamma$ (in radians) is the product of the helix angle $\alpha$ (in radians), and the beach angle $\beta$ (in radians). In the cylindrical clarifier section, where the beach angle is zero, the climb angle is of course also equal to zero. In practice, the climb angle of the beach is quite small, of the order of 1°. In order that details may be seen more easily, therefore, FIG. 13 as well as other figures to follow, has been drawn with a greatly enlarged vertical scale.

In FIG. 13, the sedimented sludge cake is overlain by the liquid slurry in a pool 224. The liquid slurry itself has comparatively small motion, and its main effect as regards sludge cake 226 is that it provides a buoyancy force that facilitates the conveyance of the sludge cake uphill.

The Velocity Profiles

Figure 14:
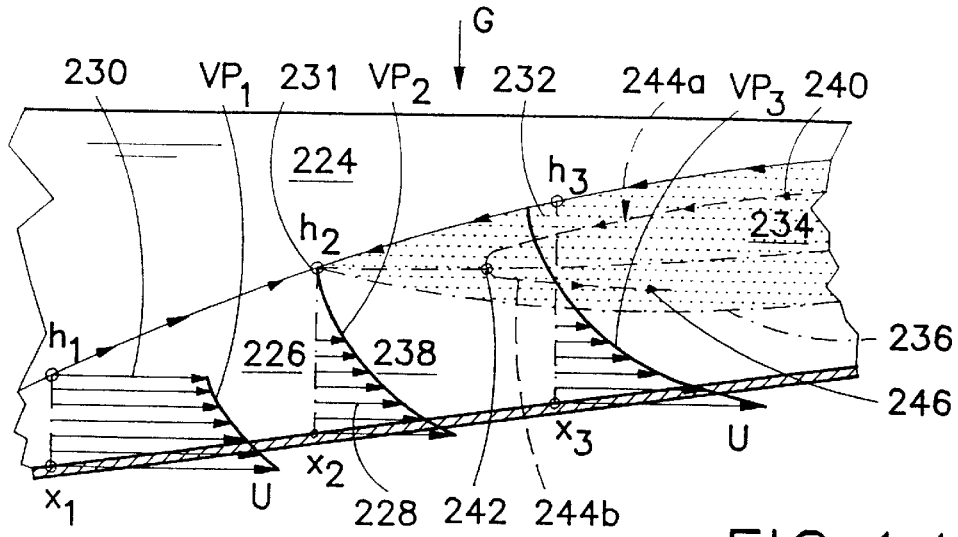
FIG. 14 is a diagram similar to FIG. 13, showing velocities and flow directions of cake sludge particles as they are conveyed upwardly, in opposition to the centrifugal force, along the beach surface.

It is assumed that the rheology of the sludge cake is such that it behaves somewhat as a liquid and that it flows under the influence of viscous stresses. With reference to FIG. 14, viscosity causes the portion of the cake sludge layer 226 immediately adjacent to the moving belt 220 (FIGS. 13 and 14) to be dragged forward with the speed U of the belt. That layer in turn exerts a viscous force on the next adjacent layer, causing it also to move uphill, but at a slightly lesser speed. This scenario is repeated, layer by layer, in chain-like fashion from the surface of the belt to the surface of the cake. Thus the sludge cake moves forward not uniformly as a solid plug or body but with a respective velocity profile $VP_1$, $VP_2$, $VP_3$, etc., and a respective thickness profile $h_1$, $h_2$, $h_3$, etc., depending on the position $x_1$, $x_2$, $x_3$ along belt 220. In FIG. 14, arrows 228 extending to the velocity profile curves $VP_1$, $VP_2$, $VP_3$ signify the speed of cake sludge particles at different distances from belt 220.

Given particular values of the cake flow rate, of the climb angle $\gamma$, and given the properties of the material forming the cake, the shapes of the velocity profiles $VP_1$, $VP_2$, $VP_3$, etc., depend upon cake height h (FIG. 13). FIG. 14 shows, for the same flow rate, velocity profiles $VP_1$, $VP_2$, $VP_3$ at three different positions $x_1$, $x_2$, $x_3$ where the respective cake heights $h_1$, $h_2$, $h_3$ are different from each other. For illustrative purposes, the cake height is assumed to increase from position $x_1$ to position $x_2$ to position $x_3$ ($h_1$ less than $h_2$ less than $h_3$). Since the flow rate is the same at the three positions $x_1$, $x_2$, $x_3$, the areas lying between the three velocity profiles $VP_1$, $VP_2$, $VP_3$ and the respective heights $h_1$, $h_2$, $h_3$ are all the same, even though the shapes are quite different from each other. At position $x_1$, the respective profile $VP_1$ is relatively uniform, and the speed at the cake-pool interface is in the forward direction, as indicated by an arrow 230. At position $x_2$, the respective profile $VP_2$ is less uniform, and the speed drops to zero at the interface between the cake sludge layer 226 and the slurry pool 224, at a point 231 (height $h_2$ above belt 220). At position $x_3$, where cake height $h_3$ is largest, the respective velocity profile $VP_3$ indicates forward flow near belt 220, but rearward flow near the cake-pool interface, as indicated by an arrow 232.

The total downhill component of the centrifugal field that acts upon cake layer 226 at any particular location is proportional to the mass of cake, and thus to the cake height h (as generically labeled in FIG. 13). With a thin layer of cake, as at position $x_1$, the frictional force applied by belt 220 is sufficient to carry the whole cake layer forward. At position $x_2$, where the mass of cake is larger, the belt friction is just barely able to support the entire cake thickness in the forward direction. When the mass of cake is even larger, as at position $x_3$, the belt friction is not sufficient to transport the entire cake thickness forward, with the result that the outer layer-of cake slips rearward.

Backflow

A zone 234 of cake backflow in FIG. 14 is shown stippled. A curve 236 divides rearward-flow zone 234 from a zone 238 of forward flow. From a point 240 to a point 242 along a streamline 244*a*, cake particle motion is rearward (away from the cake discharge opening 18); at point 242, the flow turns around, and cake particle motion is forward (toward the cake discharge opening 18) between point 242 and any subsequent point 246 of streamline 244*b*. At the interface between flowing sludge cake 226 and overlying pool 224 of slurry liquid, the cake motion is forward upstream of point 231 but rearward downstream of point 231. This pattern, emphasized by the arrowheads placed on the interface in FIG. 14, is highly significant to the present invention, as explained below.

A Conventional Cake Profile

Figure 15:
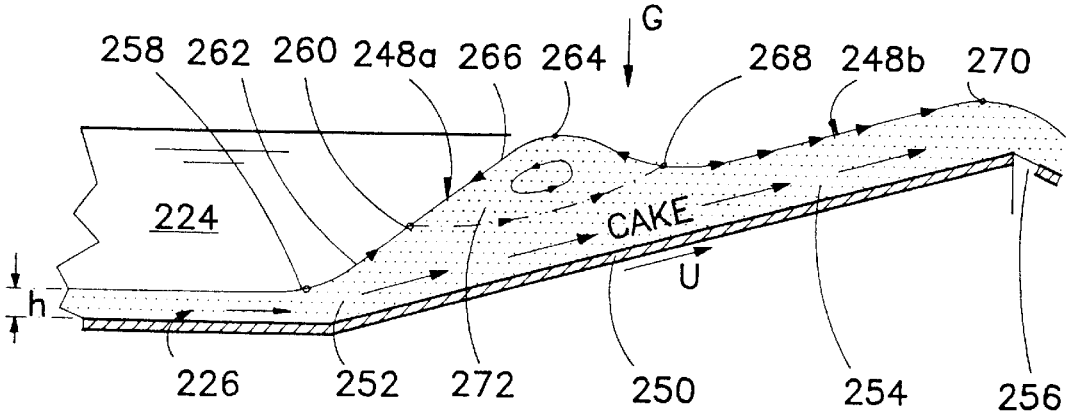
FIG. 15 is a diagram similar to FIGS. 13 and 14, showing a cake profile and cake particle flow directions along a simple beach section of a decanter centrifuge.

FIG. 15 shows, by means of the belt analog, a cake profile 248*a* and 248*b* and an associated flow pattern for a conventional centrifuge with a beach 250 of uniform angle. FIG. 15 also shows a below-pool zone 252 with cake profile 248*a*, and an above-pool zone 254 with cake profile 248*b*, or so-called "dry beach." The purpose of the dry beach 254 is to provide a drying-out area where liquid can be expressed from cake 226 without interference from an overlying pool of liquid.

The cake leaves the clarifier 256, enters the below-pool zone 252 of the beach, is transported up beach 250, and finally leaves the machine at a cake discharge port 256. The effective density of the cake experiences a jump when the cake passes from below-pool zone 252 to the above-pool zone 254, because the buoyancy provided by liquid in pool 224 is lost. It has been found that this gives rise to the cake profile 248*a* and 248*b*. From a first point 258 to a second point 260 of profile 248*a*, cake height h increases and the interface motion is forward, as indicated by an arrow 262. From second point 260 to a third point 264 along cake profile 248*a*, the cake height continues to increase, but the interface motion is rearward, as indicated by arrow 266. The cake emerges from pool 224 at point 264. From point 264 to a fourth point 268 on cake profile 248*b*, the cake height decreases, and the interface speed is rearward. Finally, from point 268 to a cake discharge point 270, the cake height remains nearly constant and the interface motion is forward. Within a triangular zone 272 defined by points 260, 264 and 268 is a trapped, recirculating vortex-like area of cake.

Along the cake profile 248*a* between points 260 and 268, the rearward motion of the interface prevents pool liquid from being entrained by the cake 226 as it emerges from pool 224. This is good, but on the other hand the interface motion between points 268 and 270 is forward. This means that when liquid is expressed from the cake in dry-beach zone 254, some part of the expressed liquid is carried forward instead of draining back into the pool. The purpose of the dry beach in expression and drainage of additional moisture from the cake is thus at least partially negated.

Conventional Compound Beach

Figure 16:
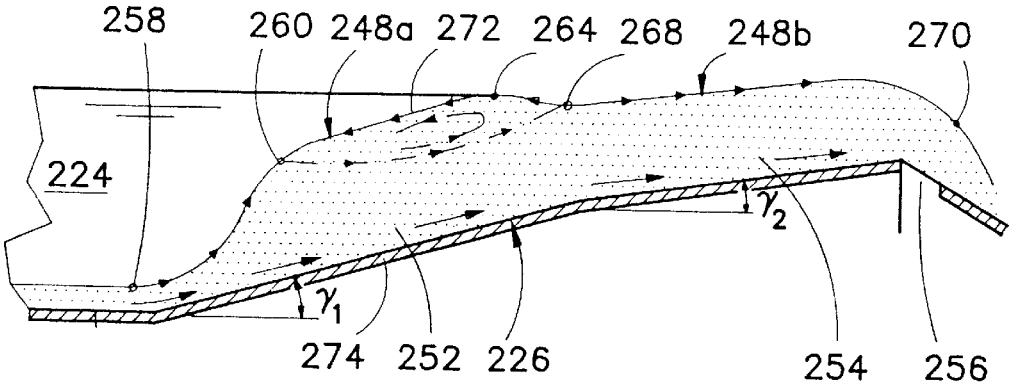
FIG. 16 is a diagram similar to FIGS. 13–15, showing a cake profile and cake particle flow directions along a compound beach.

FIG. 16 shows a compound beach 274, with a relatively large initial climb angle $\gamma_1$ in below-pool zone 252 (where buoyancy provides assist), and a relatively small climb angle $\gamma_2$ in the above-pool zone 254 (where the assisting effect of buoyancy has been lost). The cake profile, and the pattern of interface motions, are respectively similar to those in the uniform beach case, FIG. 15. Similar features are labeled with the same reference numerals in FIGS. 15 and 16. As in the single beach case, the surface of the cake moves forward in the dry beach area, carrying expressed liquid to the solids discharge end and thereby resulting in wetter cake.

Compound Beach with Flow Impedance

Figure 17:
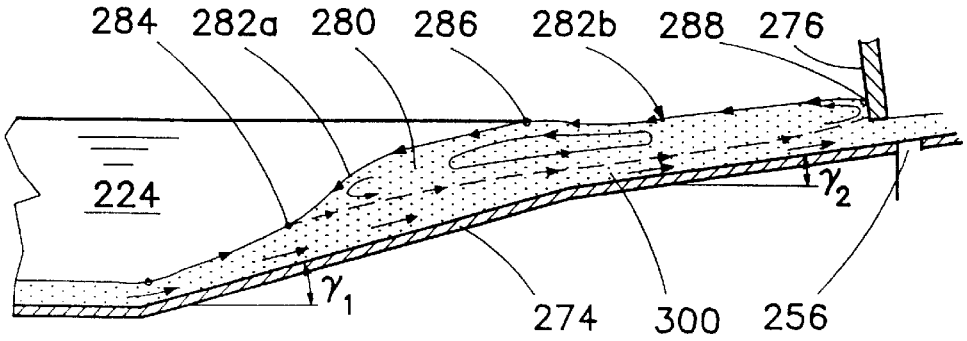
FIG. 17 is a diagram similar to FIG. 16, showing a cake profile along a compound beach section provided at a cake discharge port with a flow-control structure such as a gate.

The geometric configuration of FIG. 17 is like that of FIG. 16 (same compound beach 274), but now the cake flow is impeded by a flow-control structure 276 proximate to cake discharge port 256. Flow-control structure 276 may take the particular form of a gate, dam or weir that constricts the flow area between the gate and the inner surface of the bowl at discharge port 256. Flow-control structure 276 can assume other forms, as discussed below. When the cake flow is blocked so as to be reduced to about half the unimpeded rate, an extended recirculating zone 280 is established. Along a portion of a cake profile 282*a* between points 284 and 286, the interface motion is rearward, thus preventing pool liquid from being carried forward with the sludge cake 226. Perhaps more importantly, the interface motion of cake profile 282*b* is rearward between points 286 and 288 thus signifying that liquid expressed from the cake beyond the point of pool emergence at 286 can not be carried forward with the cake to the cake discharge port. Thus, the flow impedance imposed by flow-control structure 276 acts to enhance the cake dryness. This geometry combines the benefit of using the flow-control structure to get drier cake and the benefit of a compound beach to avoid excessive reduction of solids throughput capacity.

Compound Beach with Zero Second Angle and Flow Impedance

Figure 18A:
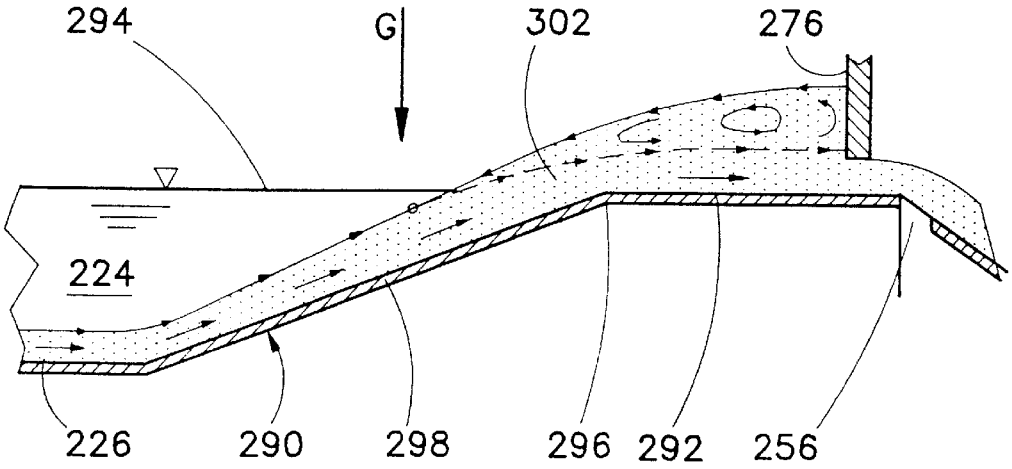
FIG. 18A is a diagram similar to FIG. 16, where a second section of the compound each has a zero climb angle.
Figure 18B:
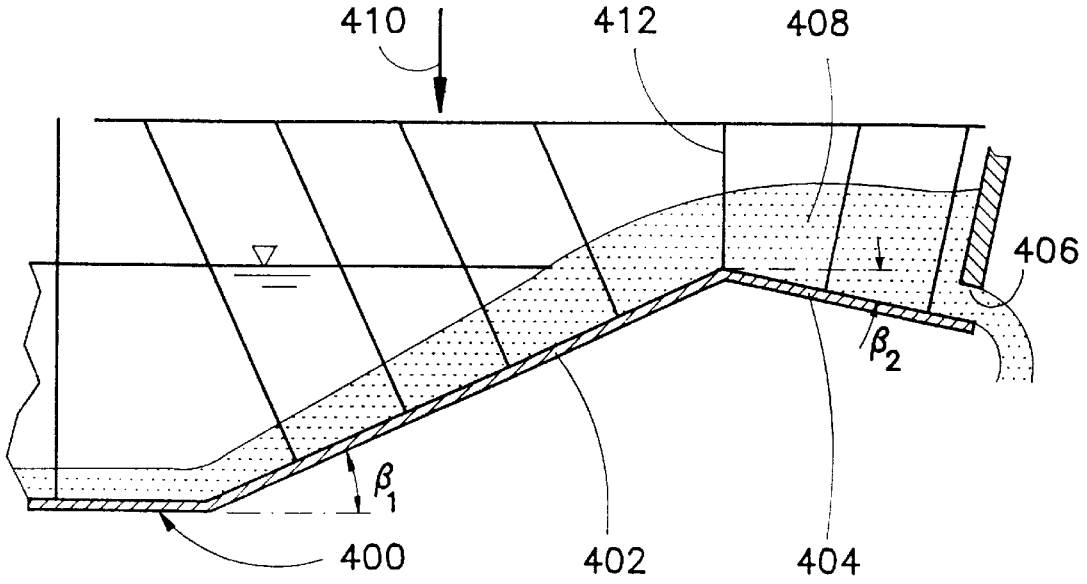
FIG. 18B is a diagram similar to FIG. 16, where a second section of the compound beach has a negative climb angle.
Figure 18C:
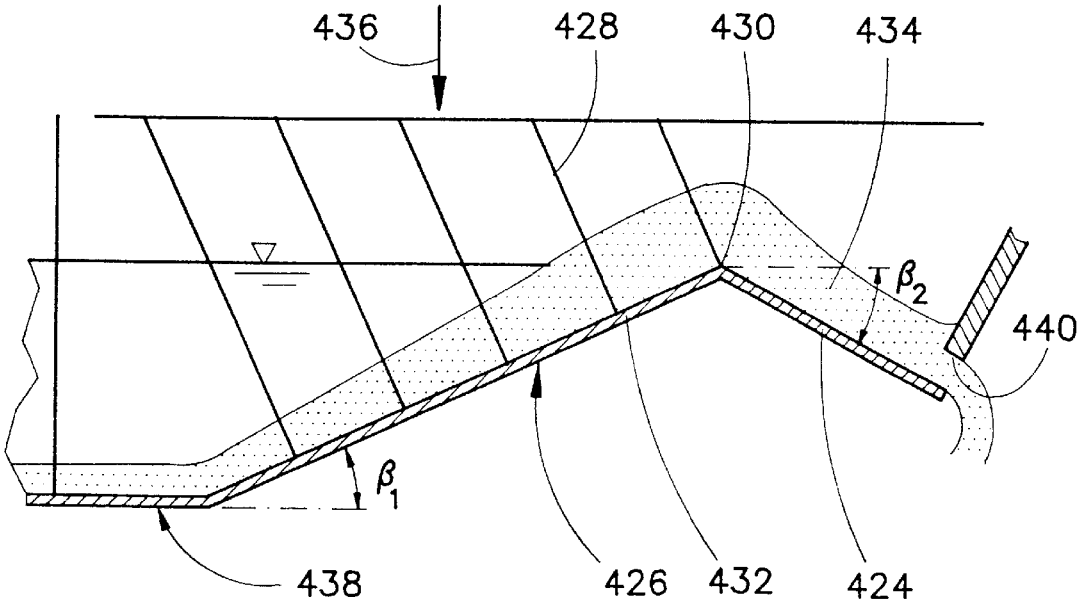
FIG. 18C is a diagram similar to FIG. 18B, where a second section of the compound beach is more negatively sloped.

FIG. 18 depicts the limiting form 290 of the compound beach where a second beach section 292 has a climb angle equal to zero. This geometery has special advantages. It provides higher cake flow capacity as compared to FIG. 17 where the second beach angle is small but nonzero and at the same time produces dry cake as with all other designs utilizing the cake-flow control structure of the present invention. Pool 224 has a level or surface 294 set very close to the level of second beach section 292, and must be adjusted carefully. Alternatively stated, pool surface 294 is approximately at the same distance from the centrifuge axis as the second beach section 292. This common distance is implemented by having the liquid discharge port at approximately the same distance from the centrifuge axis (conveyor and bowl rotation axis) as the junction 296 between a first beach section 298 and second beach section 292. Because buoyancy eases the task of lifting the sludge cake 226 against the force of the centrifugal field G, the first beach section 298 may have a relatively large beach angle, and therefore may be relatively short. The savings in length over the conventional design of FIG. 15 makes available the length required for the section beach section 292.

In an actual decanter centrifuge, a non-zero beach angle has the effect of creating a variation of cake thickness over the distance from one vane surface to the adjacent one forming the helical channel. The cake thickness is deeper at the driving face 214*a* of the conveyor vane and shallower toward the trailing face 214*b* of the adjacent conveyor vane. However, if the climb angle in the second part of the compound beach in an actual decanter is zero, the cake thickness is uniform across the helical channel formed by adjacent vanes or wraps; that is, the cross-section of the cake is rectangular, with its surface parallel to the straight beach. This is found to be advantageous to deliquoring, hence the configuration of FIG. 18 is preferred.

In some applications, it may be advantageous to provide centrifuge bowl 400 with a compound beach comprising a first beach section 402 and a second beach section 404, the latter angled slightly downward (with respect to the horizontal) towards the solids discharge opening 406 so that both the beach angle $\beta_2$ and the climb angle $\gamma_2$become negative, as illustrated in FIG. 18B. Cake 408 is dewatered in second beach section 404 under increasing G-force (arrow 410). A conveyor screw 412 also conforms to the geometry of bowl 400, including first beach section 402 and second beach section 404.

In another design shown in FIG. 19C, the climb angle $\beta_2$ of a second beach section 424 of a compound beach 426 of a centrifuge bowl 438 has a comparatively large negative value, while a conveyor screw 428 terminates at a junction 430 between a first beach section 432 and second beach section 424. In this configuration, conveyance of cake 434 on the second beach 424 is effected by means of the centrifugal field (arrow 436). In some applications, a large negative beach angle $\beta_2$, with its associated increase of G-force 436 toward a cake discharge opening 440, enhances further cake dewatering.

Description of the Preferred Embodiment

A decanter centrifuge may include more than one type of flow-control structure 276 to impede the cake flow as discussed above with reference to FIGS. 17 and 18. The flow control structures, located proximate to cake or heavy-phase discharge port 256, impede the volume flow rate of cake solids 226 conveyed out of the bowl of a decanter centrifuge. It has been found in the present invention that by reducing the solids volume flow rate by about one-half, or more generally between 25% and 75% of the otherwise unimpeded solids volume flow rate, the velocity of cake particles at an upper surface of the cake 226 is in the reverse direction, that is, back towards pool 224, over substantially the entire length of an above-pool zone 300, 302 of beach 274, 298, as well as the point (286 in FIG. 17) where the solids emerge from the pool. Liquid from pool 224 and liquid expressed from solids within the above-pool zone 300, 302 are thus rejected and drained back into the pool 224 rather than carried out of the centrifuge bowl with the sedimented cake 226. As a result, a decanter centrifuge incorporating a compound beach 274 or 298 together with an associated flow-control structure 276 produces a drier cake since less liquid reaches cake discharge port 256.

Flow-control structures as described hereinabove with reference to FIGS. 1–7 and 9 result in drier cake product. However, the drier cake is obtained at the expense of reduced cake flow capacity. In order to improve cake dryness, without the loss of cake flow capacity, the preferred geometry has a zero-degree beach in accordance with FIG. 18.

It is noted that the amount of reduction of the solids volume flow rate produced by flow control structure 276 depends on the type and consistency of the feed slurry, as well as on the dimensions and operating conditions of the centrifuge. Although reducing the solids volume flow rate by about one-half is the optimal amount of reduction when the mixture behaves substantially as a Newtonian fluid, the best way to determine the optimal amount of reduction is through empirical tests.

It is also noted that the preferred compound beach geometry with the second beach angle at zero degrees and with a flow-control structure produces drier cake and higher throughput in comparison with conventional single-beach geometries whether with flow control, which suffers from lower throughput, or without flow control, which results in wetter cake and somewhat lower throughput as compared to the preferred geometry discussed above.

Figure 19B:
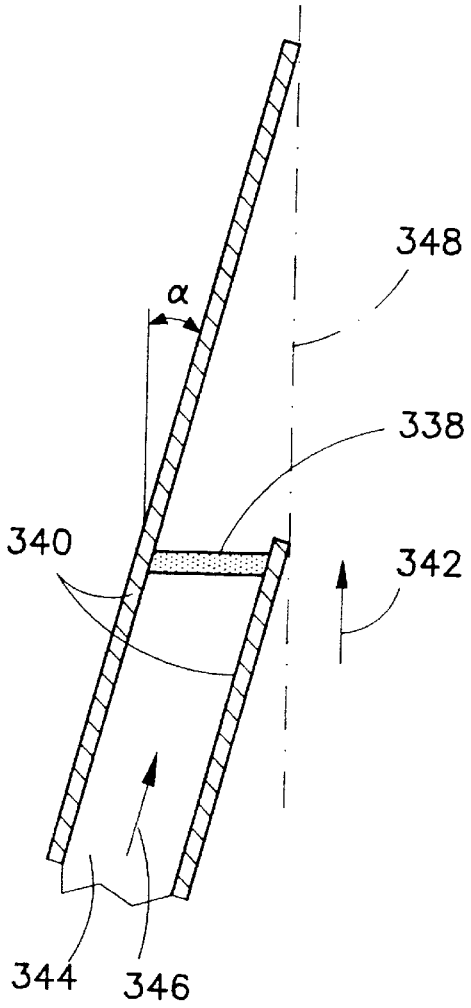
FIG. 19B is a view similar to FIG. 12, taken in the direction A—A in FIG. 19A.
Figure 19A:
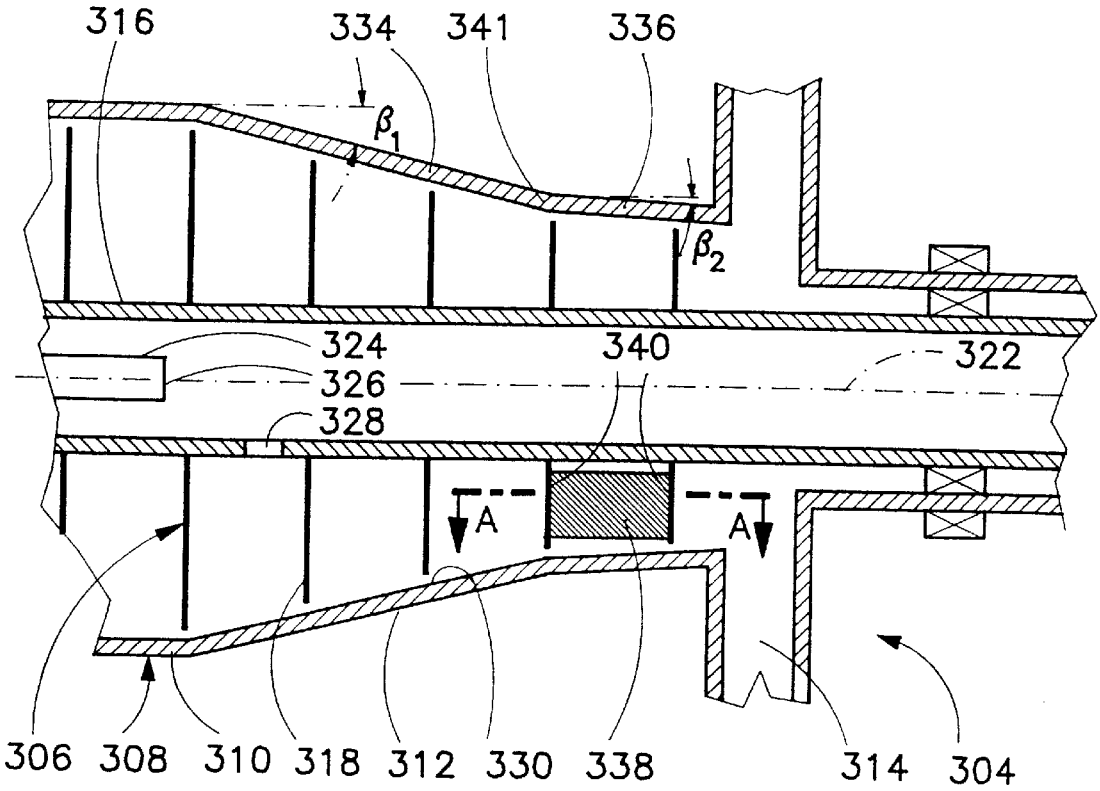
FIG. 19A is a schematic partial longitudinal cross-sectional view of a decanter centrifuge employing a flow-control structure in conjunction with a compound beach, in accordance with the present invention.

FIG. 19A shows a partial cross-sectional view of the solids end of a decanter centrifuge 304. Centrifuge 304 includes a screw-type conveyor 306 mounted within a bowl 308 having a generally cylindrical clarifier section 310, a tapered compound beach 312, and at least one heavy-phase or cake discharge port 314 communicating with the tapered beach section. Conveyor 306 includes a conveyor hub 316 and a generally helical conveyor blade or screw 318 having a plurality of turns or wraps (not separately designated) disposed about the hub 316. Bowl 308 and conveyor 306 rotate at high speeds via a driving mechanism (not shown), but at slightly different angular velocities, about an axis 322.

A slurry feed of solid/liquid mixture is introduced into the decanter centrifuge 304 through a feed pipe 324 having at least one opening 326 which allows the feed slurry to enter bowl 308 through at least one feed port 328 formed in the conveyor hub 316 and which acts as a feed accelerator. A centrifugal force field generated by the rotating pool of liquid (not shown) in rotating bowl 308 causes suspended solids in the slurry mixture to sediment on an inner surface 330 of bowl 308. The effluent liquid leaves the decanter centrifuge 304 through at least one effluent liquid discharge port (not shown) at the effluent end of the clarifier section 310. The radial location of the discharge port (which may be annular) establishes the radial level 294 (FIG. 18) of the liquid pool 224 (FIG. 18). The surface 294 of the pool 224 is substantially cylindrical.

Bowl 308 includes a tapered beach 312 including a first beach section 334 having a respective beach angle $\beta_1$ and a second beach section 336 having a respective beach angle $\beta_2$. Beach angle $\beta_2$ of section beach section 336 is less than beach angle $\beta_1$ of first beach section 334. Preferably, beach angle $\beta_2$ is approximately zero degrees.

Conveyance of the solids up beach 312, radially inward toward the axis 322, and against the counterposing outward radial force of the centrifugal field, is effected by virtue of the difference in angular velocities between bowl 308 and the conveyor 12. This differential allows the conveyor 306, having a helix angle $\alpha$, to cooperate with bowl 308 so as to transport the sedimented solids toward the discharge port 314.

The practical realization of flow-control structure 276 described above in connection with FIGS. 17 and 18 takes the form here of a dam-like structure such as a baffle or gate 338, near the exit plane of conveyor 306, that spans between two adjacent wraps 340 of helical conveyor screw 318. FIG. 19B is a view of the same gate or baffle 338 as seen looking in the radial direction A—A in FIG. 19A. Helical conveyor screw 318, particularly adjacent wraps 340, appears as a series of parallel vanes inclined at the helix angle a to the direction of rotation 342, a direction normal to the centrifuge rotation axis 322. Adjacent wraps 340 form a channel 344 along which the sludge cake is guided and transported (as indicated by arrow 346) toward a cake discharge plane 348. In order to reach cake discharge port 314 in discharge plane 348, the flow must pass through a space between the bowl wall and the most radially-outward part of gate 338. Because of the constriction of cake height as the cake passes through the gate area, the flow is impeded, in accord with the principle illustrated by FIG. 18.

Figure 20:
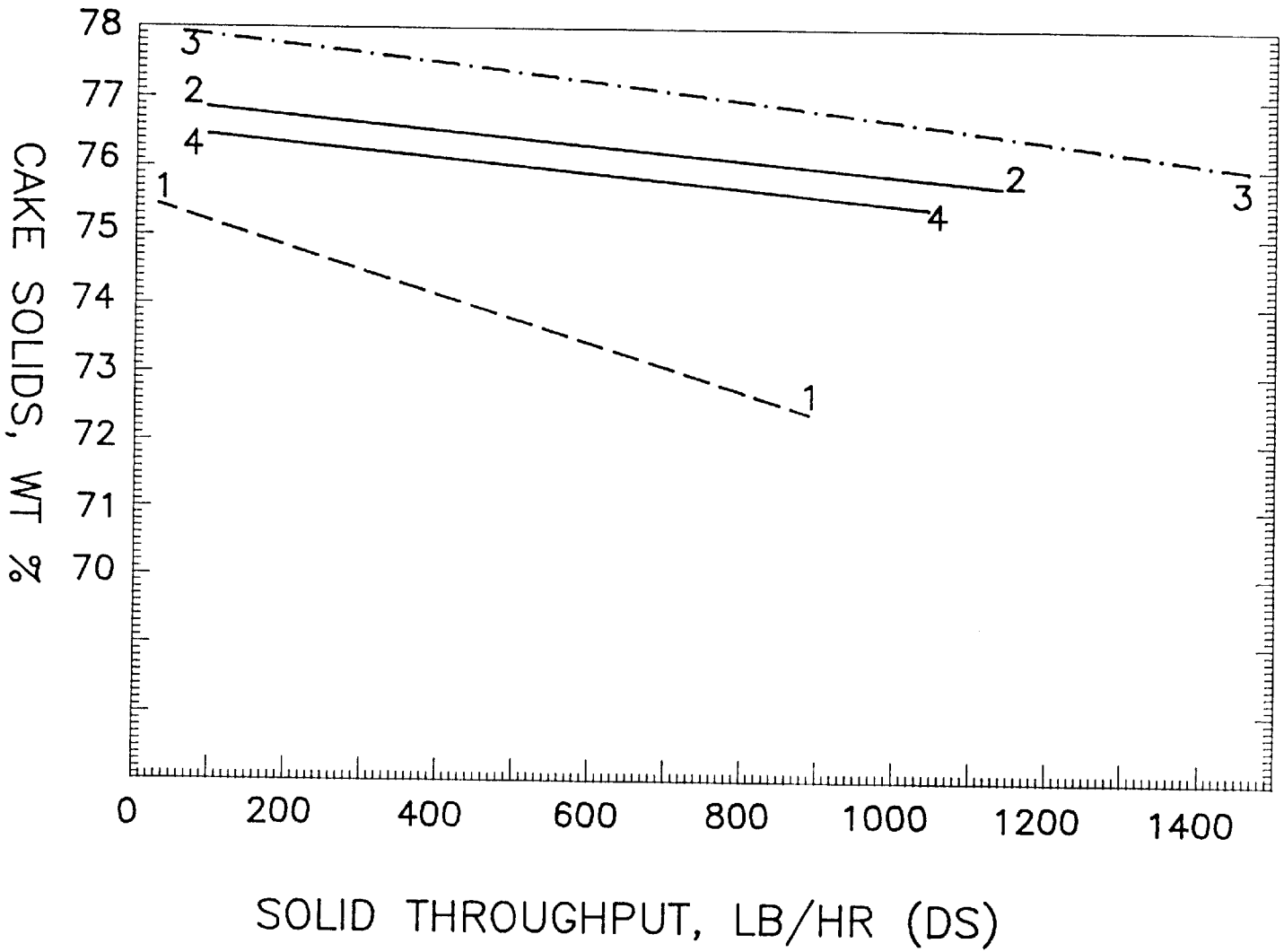
FIG. 20 is a graph illustrating cake dryness and solids throughput for different machines.

An 18-inch diameter by 28-inch length solid bowl centrifuge 304 in accordance with the preferred geometry of FIGS. 19A and 19B was built and tested on fine particle calcium carbonate slurry with 5-micron mean particles. The built centrifuge 304 has a short cylindrical clarifier 310, a first beach section 334 inclined at a 15-degree angle $\beta_1$, and a second beach section 336 inclined at a zero-degree angle $\beta_2$. Two approximately axially oriented baffles similar to baffle or gate 338 in FIGS. 19A and 19B are positioned (one at each helix in a double-helix conveyor 306) at the exit of zero-degree beach section 336 where the dry cake discharges from the machine. The pool was set close to an intersection or junction 341 between the two beaches 334 and 336. The bowl was rotated at a speed of 2000 revolution/min generating 100×gravity at the clarifier bowl wall and about 800×gravity at the zero-degree beach 336. Various radial gap widths, i.e., extent of flow control, have been tested. In FIG. 20, the results are compared with those obtained for a similar size decanter (18" diameter by 28" long) but with conventional single beach geometry under identical rotational speed. Curve 1—1 of FIG. 20 shows the cake dry solids percent obtained from the conventional decanter under different rates up to 920 lb/hr(dry basis). The results are compared with those obtained from the preferred geometry having a compound beach but with different extents of flow control—(curve 2—2) no control and large gap; (curve 3—3) some control with 0.5-in gap; and (curve 4—4) tight control with 0.25-in gap. The compound beach configurations all have much higher capacity and greater cake dryness than the conventional decanter (curve 1—1). In all cases, the cake solids obtained by the preferred geometry were about 3–4% drier as compared to those obtained with the conventional decanter. Up to 1400 lb/hr solids (dry basis) was processed at 76% cake for the preferred geometry with 0.5-in gap versus 920 lb/hr solids (dry basis) processed with the conventional decanter and at a much lower cake solids of 72.5%.

Although gate 338, in spanning the space between successive vane wraps 340, is shown in FIG. 19B as being oriented in the axial direction, it may lie at any orientation relative to the vane direction. For instance, it might be oriented to be perpendicular to the vane surfaces.

Since the optimum baffle opening is not known exactly in advance, and since it will in any event depend upon the particular rheology of the sludge cake, it is highly advantageous for the baffle position to be adjustable, even more so if the position can be adjusted on the fly, as it were. Various techniques for gating adjustability are discussed above with reference to FIGS. 1–11.

Figure 21:
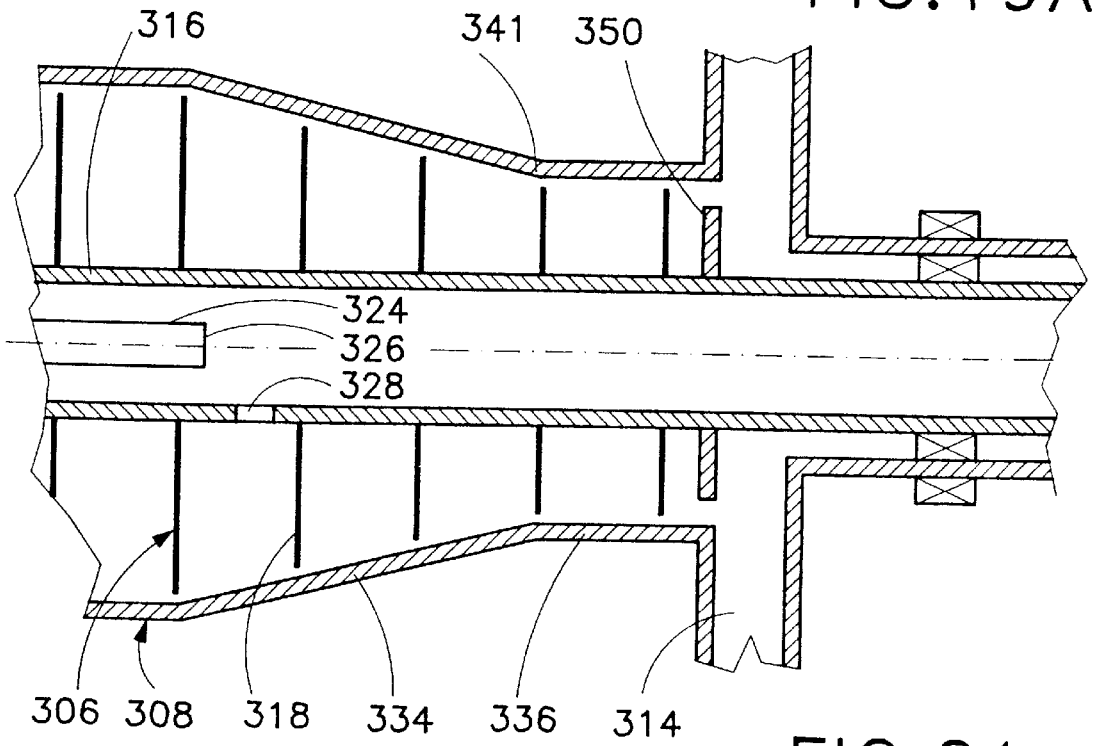
FIG. 21 is a view similar to FIG. 19A, showing a decanter centrifuge employing another flow-control structure in conjunction with a compound beach, in accordance with the present invention.
Figure 22:
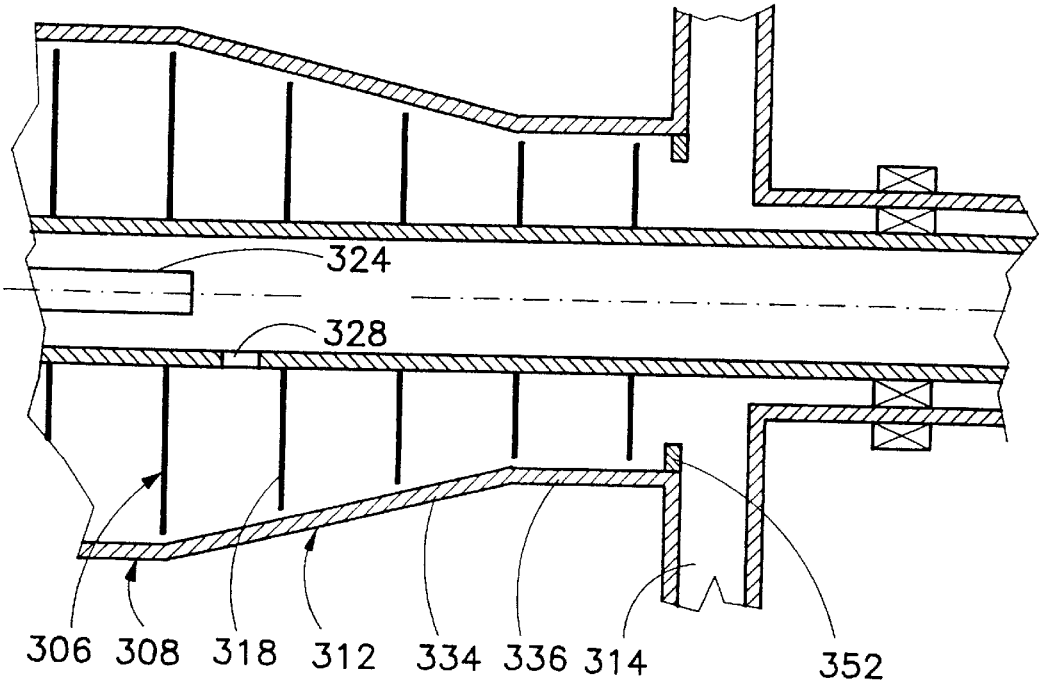
FIG. 22 is a view similar to FIGS. 19A and 21, showing a decanter centrifuge employing yet another flow-control structure in conjunction with a compound beach, in accordance with the present invention.

The guiding concept of the invention, namely, impeding the flow rate of cake by an appropriate amount, may be realized practically in ways other than by the structure of FIG. 19A. For example, FIG. 21 shows a configuration in which the flow-impeding structure is an annular ring-shaped disk 350 attached to the conveyor hub 316. Alternatively, FIG. 22 shows a flow-impeding structure in the form of an annular ring-shaped disk 352 attached to the wall of bowl 308. In FIGS. 21 and 22, the same structures as in FIG. 19A are designated by the same reference numerals.

While the flow-impeding structures of FIGS. 19A, 21, and 22 are shown as adjacent to the exit plane 348 (FIG. 19B) of conveyor 306, they may also be situated further upstream.

Figure 23:
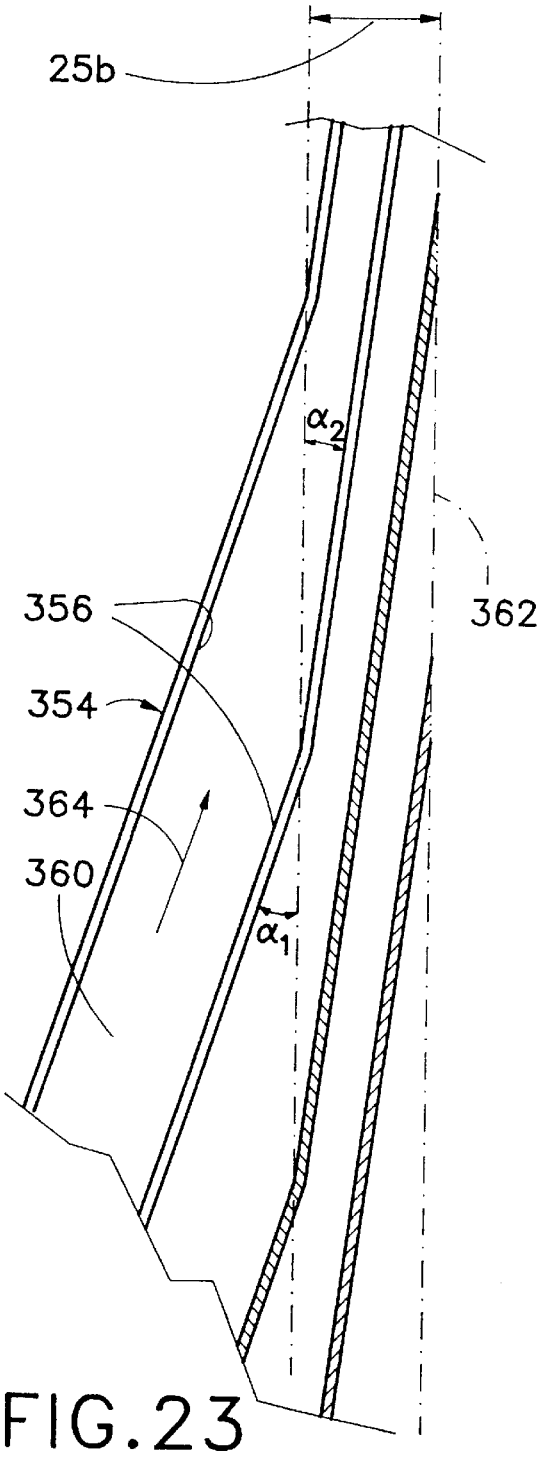
FIG. 23 is a view similar to FIGS. 12 and 19B, showing a further flow-control structure for use in conjunction with a compound beach of a decanter type centrifuge.

FIG. 23 represents the development on a plane of a conveyor screw 354 and illustrates a different way of realizing the invention. In a flow-control zone 256 near a cake discharge port (not shown), the helix angle of the conveyor 354 is reduced from a first value $\alpha_1$ to a smaller value $\alpha_2$. This change in the helix angle reduces the flow area through the channel formed by adjacent wraps 358 of conveyor screw 354 and thus establishes an impedance to the cake flow. Each pair of adjacent vanes or wraps 358 forms a channel 360 along which the sludge cake is guided and transported, as indicated by an arrow 364, toward a cake discharge plane 362.

Figure 24:
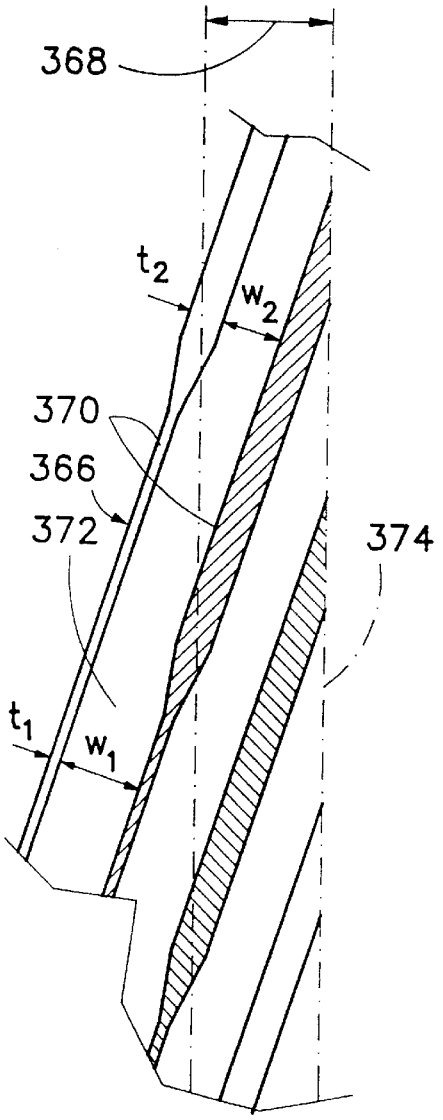
FIG. 24 is a view similar to FIG. 23, showing an additional flow-control structure for use in conjunction with a compound beach of a decanter type centrifuge.

A further embodiment of the flow-control concept is shown in FIG. 24, which is also a representation of a conveyor screw 366 developed on a plane. Here, in a flow-control zone 368 adjacent a cake discharge port, the thickness of the conveyor screw vane or wrap 370 is increased from the relatively small value $t_1$ typical of conventional practice to a relatively large value $t_2$ in the flow-control zone 368. By this means the cross-sectional area for cake flow through a channel 372 formed by adjacent wraps 370 of the conveyor screw 366 is decreased from $w_1$ to the smaller value $w_2$ in flow-control zone 368, thereby providing an impedance to the flow of cake towards a cake discharge plane 374.

Although the several embodiments of the flow-control concept shown in FIGS. 19A, 21, 22, 23 and 24 have been shown in the context of a compound beach 312 in which the second beach section 336 has a zero beach angle $\beta_2$, these embodiments may also be applied to a compound beach in which the second beach section 338 has a non-zero beach angle. Under certain circumstances, they may also advantageously be applied to a beach with a uniform beach angle.

Figure 25:
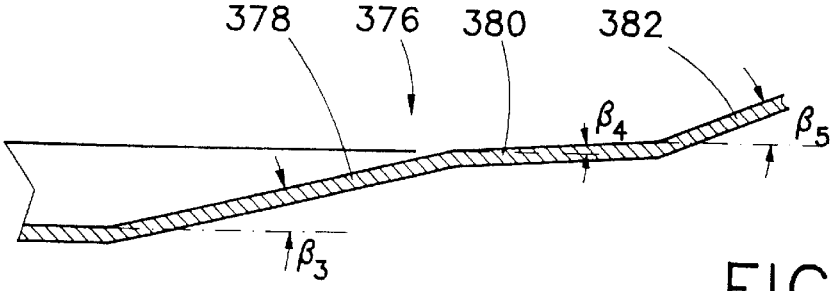
FIG. 25 is a schematic partial longitudinal cross-sectional view of a compound beach in accordance with the present invention.

Another beach geometry incorporating the flow-control concept is depicted schematically in FIG. 25. A beach 376 has three sections: a below-pool zone 378 with a relatively large beach angle $\beta_3$; an above-pool zone 380 with a relatively small or a zero beach angle $\beta_4$; and a flow-control zone 382 having a beach angle $\beta_5$ larger than that of the second beach section 380. The last beach section 382 provides the flow impedance that results in the flow pattern illustrated by FIG. 18.

Although the invention in its various forms has been described in the context of separating the solid and liquid components of a feed slurry, it is equally applicable to the separation of a heavier-phase liquid from a lighter-phase liquid.

What is claimed is:

1. A decanter centrifuge comprising:

a bowl rotatable about a longitudinal axis, said bowl having a cake discharge opening at one end and a liquid phase discharge opening, said bowl having a cylindrical portion and an imperforate beach portion between said cylindrical portion and said cake discharge opening, a beach area being provided on an inner surface of said bowl at said beach portion;

a conveyor having at least a portion disposed inside said bowl for rotation about said longitudinal axis at an angular speed different from an angular rotational speed of said bowl, said conveyor including a helical screw disposed inside said bowl for scrolling a deposited solids cake layer along said inner surface of said bowl towards said cake discharge opening;

a feed element extending into said bowl and said conveyor for delivering a feed slurry into a pool inside said bowl; and a flow control structure disposed inside said bowl in said beach area proximate to said cake discharge opening for impeding a flow of cake along said beach area towards said cake discharge opening to thereby produce cake with reduced moisture content, said beach area including a first section of a steep slope and a second section of a less steep slope for maintaining a high throughput of cake towards said cake discharge opening in opposition to the impedance provided by said flow control structure said second section being located between said first section and said cake discharge opening, said first section having a diameter which decreases at a first rate with axial displacement towards said cake discharge opening, said second section having a diameter which changes at a second rate with axial displacement towards said cake discharge opening, said second rate being less than said first rate.

2. The centrifuge defined in claim 1 wherein said flow control structure increases a cake flow cross-section upstream of said flow control structure and is disposed along said second section of said beach area.

3. The centrifuge defined in claim 1 wherein said conveyor has a hub to which said helical screw is attached, said flow control structure including a barrier extending radially from said hub towards said bowl.

4. The centrifuge defined in claim 1 wherein said flow control structure includes a barrier extending radially inwardly from said bowl towards said conveyor.

5. The centrifuge defined in claim 1 wherein said flow control structure includes a portion of said helical screw having thickened wraps.

6. The centrifuge defined in claim 1 wherein said helical screw includes, in said cylindrical portion of said bowl, a first plurality of wraps having a first helix angle and further includes a second plurality of wraps having a second helix angle, said flow control structure including said second plurality of wraps, said second helix angle being different from said first helix angle.

7. The centrifuge defined in claim 1 wherein said flow control structure includes an additional beach section disposed between said second section of said beach area and said cake discharge opening, said additional beach section being steeper than said second section.

8. The centrifuge defined in claim 1 wherein said first section and said second section of said beach area are contiguous with one another along ajunction, said liquid phase discharge opening being disposed at a predetermined distance from said longitudinal axis, said junction being disposed at approximately said predetermined distance from said longitudinal axis, whereby said pool is approximately coextensive with said cylindrical portion and said first section of said beach area and whereby said second section of said beach area is disposed outside of said pool.

9. The centrifuge defined in claim 1 wherein said second section of said beach area has a slope of approximately 0°.

10. The centrifuge defined in claim 1 wherein said second section of said beach area has a negative slope so that said beach diverges from a hub of said conveyor towards said cake discharge opening.

11. The centrifuge defined in claim 10 wherein said negative slope is substantial and said screw conveyor terminates at a longitudinal location upstream of said second section of said beach area.

12. The centrifuge defined in claim 1 wherein said conveyor is provided with a plurality of screw wraps, said flow control structure including a baffle plate disposed between adjacent ones of said screw wraps.

13. The centrifuge defined in claim 1 wherein said helical screw has a multiplicity of first screw wraps in said beach area and a multiplicity of second screw wraps in said beach area, said second screw wraps being located closer than said first screw wraps to said cake discharge opening, said first screw wraps having a first helix angle and said second wraps having a second helix angle different from said first helix angle.

14. The centrifuge defined in claim 1 wherein said flow control structure includes an element providing an impediment to a flow of cake along said beach area towards said cake discharge opening, independent of position of said conveyor and said bowl relative to one another, so that said cake flows at a constant rate along said beach area towards said cake discharge opening during rotation of said conveyor and said bowl.

15. The centrifuge defined in claim 1 wherein the diameter of said second section of said beach area decreases with axial displacement towards said cake discharge opening, the diameter of said first section decreasing at a relatively large rate with axial displacement towards said cake discharge opening, the diameter of said second section of said beach area decreasing at a smaller rate with axial displacement towards said cake discharge opening.

16. A decanter centrifuge comprising:

a bowl rotatable about a longitudinal axis, said bowl having a cake discharge opening at one end and a liquid phase discharge opening, said bowl having a cylindrical portion and a beach portion between said cylindrical portion and said cake discharge opening, a beach area being provided on an inner surface of said bowl at said beach portion, said beach area including a first section of a steep slope and a second section of a less steep slope for maintaining a high throughput of cake towards said cake discharge opening, said second section being located between said first section and said cake discharge opening, said first section having a diameter which decreases at a first rate with axial displacement towards said cake discharge opening, said second section having a diameter which changes at a second rate with axial displacement towards said cake discharge opening, said second rate being different from said first rate;

a conveyor having at least a portion disposed inside said bowl for rotation about said longitudinal axis at an angular speed different from an angular rotational speed of said bowl, said conveyor including a helical screw disposed inside said bowl for scrolling a deposited solids cake layer along said inner surface of said bowl towards said cake discharge opening;

a feed element extending into said bowl and said conveyor for delivering a feed slurry into a pool inside said bowl; and an adjustable flow control structure mounted to said conveyor and disposed inside said bowl in said beach area proximate to said cake discharge opening for impeding a flow of cake along said beach area towards said cake discharge opening to thereby produce cake with reduced moisture content, said flow control structure being spaced a variable and adjustable predeterminable distance from said inner surface of said bowl, said first section and said second section serving to maintain a high throughput of cake towards said cake discharge opening in opposition to the impedance provided by said flow control structure.

* * * * *